US007770633B2

(12) United States Patent
Miyahara

(10) Patent No.: US 7,770,633 B2
(45) Date of Patent: Aug. 10, 2010

(54) PLATE TYPE HEAT EXCHANGER AND METHOD OF MANUFACTURING THE SAME

(75) Inventor: Hideyuki Miyahara, Nagano-ken (JP)

(73) Assignee: Nakamura Seisakusho Kabushikigaisha, Okaya-Shi, Nagano-Ken (JP)

( * ) Notice: Subject to any disclaimer, the term of this patent is extended or adjusted under 35 U.S.C. 154(b) by 1050 days.

(21) Appl. No.: 11/472,500

(22) Filed: Jun. 21, 2006

(65) Prior Publication Data

US 2007/0012431 A1 Jan. 18, 2007

(30) Foreign Application Priority Data

Jun. 27, 2005 (JP) ..... 2005-187489
Sep. 26, 2005 (JP) ..... 2005-278944

(51) Int. Cl.

| | |
|---|---|
| ***F28F 3/14*** | (2006.01) |
| ***F28F 17/00*** | (2006.01) |
| ***F24H 9/02*** | (2006.01) |
| ***F24H 3/00*** | (2006.01) |
| ***F28F 1/20*** | (2006.01) |

(52) U.S. Cl. ..... 165/170; 165/94; 165/128; 165/129; 165/130; 165/131; 165/181

(58) Field of Classification Search ..... 165/170, 165/94, 181, 128–131
See application file for complete search history.

(56) References Cited

U.S. PATENT DOCUMENTS 3,901,312 A * 8/1975 Pasternak ..... 165/181
2002/0062648 A1* 5/2002 Ghoshal ..... 62/3.7
2003/0121645 A1* 7/2003 Wang ..... 165/104.26

FOREIGN PATENT DOCUMENTS

| | | |
|---|---|---|
| JP | 11-023167 | 1/1999 |
| JP | 2000-193385 | 7/2000 |

* cited by examiner

*Primary Examiner*—Frantz F. Jules
*Assistant Examiner*—Travis Ruby
(74) *Attorney, Agent, or Firm*—Flynn, Thiel, Boutell & Tanis, P.C.

(57) ABSTRACT

A method for manufacturing a plate-type heat exchanger in which a heat medium is sealed in a hollow part of an airtight structure formed in the interior of a plate-like container, and the heat medium is moved by capillary force from a condensing part to an evaporating part in the hollow part along heat-medium-guiding grooves formed in the container's inside surface portions that face the hollow part; wherein a plastic workable metal plate of specific thermal conductivity is prepared; a carving tool is used to repeatedly carve out a surface portion of the metal plate at specific intervals along the surface portion, forming a plurality of plate-like fins; and a plurality of grooves formed between these fins is used as heat-medium-guiding grooves. A plate-type heat exchanger is obtained which comprises extremely small heat-medium-guiding grooves that have the necessary capillary force to move the heat medium from the condensing part to the evaporating part without affecting the set alignment or other such characteristics.

9 Claims, 27 Drawing Sheets

(A)

(B)

(C)

(A)

(B)

(C)

(A)

(B)

(A)

(B)

(Prior Art)

PLATE TYPE HEAT EXCHANGER AND METHOD OF MANUFACTURING THE SAME

FIELD OF THE INVENTION

The present invention relates to a plate-type heat exchanger that is suitable for use as a flat heat pipe or a vapor chamber that is used to cool a semiconductor chip, an integrated circuit board, or another heat generator; and to a method for manufacturing the same.

RELATED ART

Recently, computer devices have been rapidly becoming smaller and more highly functional. As these devices become more highly functional, greater amounts of heat are generated from the semiconductor elements and integrated circuits in these devices, and effective cooling methods are becoming problematic with respect to making computer devices even smaller and even more highly functional.

Various cooling systems have been proposed to cool high-output, high-integration chips and the like. Focus has been given to liquid-cooled heat exchangers, typified by heat pipes, as such cooling systems. As a liquid-cooled heat exchanger, a heat pipe may be shaped as a round heat pipe or a flat heat pipe. To cool an electronic device, a heat pipe must be attached to the power source, which is a chip or another component, and a flat heat pipe is therefore preferred. Heat pipes that have been proposed in the prior art have an interior space that serves as a flow channel for a working fluid, which is a heat medium. The working fluid accommodated within this space moves between an evaporating part and a condensing part, and the chip or the like is cooled as a result of repeated phase changes between vaporization and condensation.

Specifically, in the evaporating part of a heat pipe, the working fluid is vaporized by the heat generated from the component to be cooled, and the vapor moves to the heat-radiating side of the heat pipe. The vaporized working fluid is cooled and condensed on the heat-radiating side, and is then changed back to working fluid in the liquid phase and moved (circulated) to the endothermic side. This phase transformation and movement of the working fluid causes heat transfer. In a gravity-type heat pipe, the working fluid that brought to a liquid phase by the phase transformation is moved to the endothermic side by gravity or capillary action.

A flat heat pipe is disclosed in JP-A 11-23167 (Patent Reference 1). In this heat pipe, a condensable fluid as a working fluid is sealed in a vacuum-degassed state inside a container 201 that is composed of a hollow-plate sealed structure, and grooves 205 that connect the evaporating part with the condensing part are formed in the inner surface of the container 201, as shown in FIG. 27. Also, a porous layer 206 that creates capillary pressure is formed over the open parts of the grooves 205, and the porous layer 206 covers the grooves 205 in a manner that does not close off the spaces in the grooves 205.

According to the heat pipe 200 in Patent Reference 1, the heat transmitted to part of the container 201 heats and vaporizes the liquid-phase working fluid, and the working fluid vapor leaves the spaces inside the porous layer 206 and the grooves 205 and flows to the condensing part, where the fluid is cooled and condensed. The working fluid that has been brought back to liquid phase in the condensing part enters the gaps in the porous layer 206 and reaches the spaces in the grooves 205. This liquid-phase working fluid is moved towards the evaporating part by the capillary pressure in the porous layer 206. In this case, the porous layer 206 acts as a wick to prevent dispersion of the liquid-phase working fluid moving through the spaces in the grooves 205, facilitates circulation of the working fluid to the evaporating part, and improves heat transport capacity.

JP-A 2000-193385 (Patent Reference 2) discloses a heat pipe in which grooves are formed in the interior of a container, and in which a liquid-phase working fluid flows through. In this flat heat pipe, grooves having capillary force are formed in the inner side of a bottom member in a multi-hole tube composed of a support member as well as a top member and bottom member having holes arrayed in parallel. The working fluid is sealed inside the multi-hole tube.

This flat heat pipe 200 is placed in the interior of a personal computer case, and a condensing part 204 of the container 201 is disposed so as to be bonded to a metal electronic shield 211 or another heat-radiating member disposed in the case, as shown in FIG. 27. An evaporating part 203 of the container 201 is disposed to be capable of heat transfer on the top surface of a CPU 213. When the CPU 213 (a semiconductor element, an integrated circuit, or another heat-generating component) generates heat, the heat is conducted to the container 201, and the working fluid in the grooves is vaporized. The heat of vaporization is consumed by the vaporization process. Therefore, the heat generated from the CPU 213 is consumed and an excessive temperature increase in the CPU 213 is prevented. The vaporized working fluid flows towards the condensing part 204, and is cooled and condensed by the heat-radiating member to be brought back to the liquid phase. The working fluid that has returned to the liquid phase is moved to the evaporating part 203 by the capillary pressure of the porous layer 206 that acts as a wick. Temperature increases in the CPU 213 and other heat-generating components are suppressed by the repeating phase transformation and movement of the working fluid and vapor as described above.

As described above, heat pipes proposed in the prior art have grooves formed in the interior of a container to allow liquid-phase working fluid to flow through. These grooves are vital to creating capillary force for moving the working fluid. However, in most cases, since these grooves are integrally formed in the container by extrusion, the grooves will necessarily increase in width, and sufficient capillary force will not be obtained. As a result, when the alignment of the heat pipe is set so that the position of the evaporating part is higher than the condensing part, the capillary force is insufficient, and the working fluid that has been returned to the liquid phase by the condensing part can no longer be returned to the evaporating part. Therefore, the flow rate of working fluid is reduced, the amount of working fluid in the evaporating part gradually becomes insufficient, and eventually the evaporating part dries up and the heat-generating components can no longer be cooled. The temperature of the heat-generating components thereby rises excessively, causing reductions or failures in the performance of the heat-generating components, which are semiconductor elements and integrated circuits and the like.

To create sufficient capillary force in the grooves of the container in the heat pipe, the grooves must be formed at a width in a range of 0.01 to 1.0 mm. However, a fairly precise machining technique is required to form grooves of such a precise width. It has been difficult to form grooves of such width by using commonly adopted conventional extrusion techniques. Particularly, extrusion is impossible with a copper material having good thermal conductivity.

Stainless steel, nickel, titanium, glass, ceramics, and other materials can be used for the container. However, it has been difficult to form grooves of such precise width when these materials are machined using a forming operation other than extrusion.

Therefore, as is disclosed in Patent Reference 1 mentioned above, it has been necessary to use a porous layer in addition to the grooves, and to have the porous layer act as a wick by means of capillary force. In addition, wires or the like are sometimes inserted into the grooves to supplement the capillary force, but the using such auxiliary members to enhance capillary force leads to increased costs. Moreover, the auxiliary members that enhance capillary force are disposed nonuniformly in the minute grooves, causing the cooling capacity to become nonuniform and leading to problems in terms of reliability.

With this type of heat pipe, the working fluid is sealed in a vacuum-degassed state in the hollow part of the container, and the hollow part is then sealed. To achieve a vacuum-degassed state in the hollow part, a main body member and a lid member for configuring the container are placed in the interior of a vacuum furnace in which a vacuum state has been created, the working fluid is poured into the main body member, the lid member is then fitted on, and the joining surfaces are sealed by soldering or another sealing method.

To create a specific vacuum state in the hollow part inside the container, the interior of the vacuum furnace that is used for the aforementioned operation must be brought to the same vacuum state as the hollow part. This vacuum state leads to problems in that the working fluid sometimes boils, and it is difficult to pour in the working fluid. In cases in which the joining surfaces of the main body member and the lid member are sealed to achieve an airtight structure in the hollow part, problems are encountered in that the sealing operation for achieving a vacuum state in the vacuum furnace is very difficult to accomplish.

Therefore, there is a possibility that the working fluid will be insufficient, the evaporating part will not contain enough working fluid, the heat-generating components will not be adequately cooled, and the temperature of the heat-generating components will increase excessively, leading to reductions or failures in the performance of heat-generating components such as semiconductor elements and integrated circuits. Also, since the joining surfaces of the main body member and the lid member are not completely sealed, severe problems may occur, such as an increase in the degree of vacuum in the hollow part, an inability of the working fluid to smoothly change phases or move smoothly, inadequate thermal transfer, and a marked reduction in the cooling capacity of the heat pipe.

SUMMARY OF THE INVENTION

An object of the present invention is to provide a plate-type heat exchanger comprising heat-medium-guiding grooves of extremely small widths that have the necessary capillary force to move a heat medium from a condensing part to an evaporating part without affecting the set alignment or the like.

Another object of the present invention is to provide a method for manufacturing a plate-type heat exchanger comprising heat-medium-guiding grooves of extremely small widths that have the necessary capillary force to move a heat medium from a condensing part to an evaporating part without affecting the set alignment or the like.

Still another object of the present invention is to provide a plate-type heat exchanger comprising a structure in which a heat medium can easily be poured into a hollow part having heat-medium-guiding grooves of extremely small widths formed in the inner peripheral surface portion, and a specific vacuum state can be easily established in the hollow part.

Yet another object of the present invention is to provide a method for manufacturing a plate-type heat exchanger whereby a heat medium can easily be poured into a hollow part having heat-medium-guiding grooves of extremely small widths formed in the inner peripheral surface portion, and the hollow part can be easily degassed to achieve a vacuum state.

The plate-type heat exchanger of the present invention comprises:

a plate-type container configured from a plastic workable metal material of specific thermal conductivity;

an airtightly structured hollow part formed in the interior of the container;

a heat medium sealed in the hollow part;

a plurality of plate-shaped fins formed by using a carving tool to repeatedly carve out the inside surface portion of the container that faces the hollow part, at specific intervals along the inside surface portion; and a plurality of heat-medium-guiding grooves formed between the fins; wherein the heat-medium-guiding grooves are set at widths that allow the heat medium to be moved along the heat-medium-guiding grooves by capillary force.

According to the present invention, heat-medium-guiding grooves for guiding the heat medium to the evaporating part from the condensing part in the hollow part are formed in the inside surface portion that faces the hollow part in which the heat medium is sealed in the plate-type heat exchanger, and these heat-medium-guiding grooves are formed between the plate-shaped fins that are formed in an upright manner at specific intervals by carving out the surface portion of the metal material that forms the container. Since the plate-shaped fins are formed at extremely small intervals by carving out the surface portion of the metal material, heat-medium-guiding grooves of extremely small widths having sufficient capillary force are formed between the fins. It is thereby possible to reduce the effects of differences in alignment in a plate-type heat exchanger such as a plate-type heat pipe or vapor chamber on the heat medium transfer capacity of the heat-medium-guiding grooves. It is also possible to suppress nonuniformities in the heat medium transfer capacity of the heat-medium-guiding grooves. As a result, a plate-type heat exchanger with high cooling efficiency can be obtained.

In the present invention, the grooves are rectangular in cross section, and at least one of the inset corners in the bottoms of the grooves has an acute angle. Thus, if the cross-sections of the grooves are rectangles, then a greater capillary force can be created than with other shapes. Even greater capillary force can be achieved by providing inset corners that have acute angles.

Also, in the present invention, the container comprises a container main body and a container lid placed over the container main body, wherein the hollow part is formed on the inner sides of the airtight frame-shaped joining surfaces between the container main body and the container lid, and a concavity for forming the hollow part on the inner sides of the frame-shaped joining surfaces is formed in at least one element selected from the container main body and the container lid.

In this case, the fins and grooves can be formed on the inside surface portions that face the hollow part in at least one element selected from the container main body and the container lid.

Thus, by joining two members, a plate-type container comprising a hollow part having a sealed structure can easily be configured. Also, in cases in which fins are formed in the inside surface portions of both members and heat-medium-guiding grooves are formed, it is possible to greatly increase the heat medium transfer capacity and the cooling capacity. Furthermore, the members can be formed into flat plates in cases in which fins are formed on the sides of the members on which there are no concavities. The plate-shaped fins can therefore be easily formed in the surface.

Next, the plate-type heat exchanger of the present invention has a communication hole sealing part formed in the container, wherein the communication hole sealing part is designed so that a communication hole formed in advance in the container to communicate the hollow part with the exterior is formed by sealing the hollow part after pouring in the heat medium and vacuum-degassing the hollow part.

In the present invention, a communication hole for communicating the hollow part of the plate-type heat exchanger with the exterior is formed in advance, and the communication hole is sealed to form the communication hole sealing part. The working fluid, which is the heat medium, is poured into the hollow part through the communication hole, and the hollow part can be vacuum-degassed to achieve a specific vacuum state. The operation of vacuum-degassing the hollow part into which the working fluid has been poured can also be performed in a room at normal pressure. Moreover, problems such as boiling of the working fluid can be prevented in advance. Furthermore, since the communication hole is sealed after the hollow part is vacuum-degassed, a specific vacuum state can be maintained in the hollow part of the plate-type heat exchanger. As a result, a plate-type heat exchanger that performs well and that is highly reliable can be obtained because the working fluid poured into the plate-type heat exchanger is constantly moving and undergoing phase transformation.

In the present invention, the open end of the communication hole on the hollow part side is formed at a position that faces medium-accumulating parts formed in the regions adjacent to the ends of the grooves in the hollow part.

Also, the present invention comprises two communication hole sealing parts, whereby the communication holes formed in the vicinity of the ends of the grooves are sealed.

Furthermore, in the present invention, the communication hole sealing part is formed by crushing and cutting away the base portion of a communication tube that protrudes from the outside surface of the container communicated with the communication hole. If a communication tube protruding from the container surface is provided, a feed pipe can easily be fitted or an injection needle can easily be inserted to pour in the working fluid, and the operation of connecting the pipe that is connected to the vacuum pump is also made easier.

Furthermore, in the present invention, the container comprises a container main body and a container lid placed over the container main body; the hollow part is formed on the inner sides of the airtight frame-shaped joining surfaces between the container main body and the container lid; a concavity for forming the hollow part on the inner sides of the frame-shaped joining surfaces is formed in at least one element selected from the container main body and the container lid; the communication hole is formed from a communication groove that is formed on the side of at least one element selected from the container main body and the container lid along the frame-shaped joining surfaces; and the communication hole sealing part is formed by applying pressure to and blocking off the communication groove.

Next, the metal material of the container can be aluminum, an aluminum alloy, copper, a copper alloy, or stainless steel.

Also, the fins can have a thickness of 0.1 mm to 1 mm, and the grooves can have widths of 0.01 mm to 1.0 mm at the bottom surfaces thereof, and depths of 0.1 mm to 1.0 mm.

The present invention is a method for manufacturing a plate-type heat exchanger in which a heat medium is sealed in a hollow part of an airtight structure formed in the interior of a plate-like container, and the heat medium is moved by capillary force from a condensing part to an evaporating part in the hollow part along heat-medium-guiding grooves formed in the container's inside surface portions that face the hollow part; wherein a plastic workable metal plate of specific thermal conductivity is prepared;

a carving tool is used to repeatedly carve out a surface portion of the metal plate at specific intervals along the surface portion, forming a plurality of plate-like fins; and a plurality of grooves formed between these fins is used as heat-medium-guiding grooves.

In a step of forming the plate-like fins:

a blade of a carving tool is pushed into a surface of the metal plate at a specific angle;

this state is maintained while the carving tool is moved a specific distance relative to the surface of the metal plate, the surface portion of the metal plate is carved out in a specific thickness by the blade, and a plate-like fin is formed in an upright manner from the surface portion of the metal plate; and the fin carving process is repeated so that the blade end of the carving tool is retracted by a specific distance relative to the formed fin and is then caused to carve out the surface of the metal plate to form a new fin.

Also, in the fin carving process:

when a new fin is formed, the blade end of the carving tool is stopped just short of the previously formed fin by a specific distance, the cross-sectional shape of the bottom side of the groove formed between the newly formed fin and the previously formed fin is fashioned into a rectangular shape, and one of the inset corners in the bottom of the groove is set to an acute angle.

According to the manufacturing method of the present invention, the surface portion of the metal portion is carved with the carving tool in the direction toward the metal plate, whereby plate-like fins are integrally formed in an upright manner, and the grooves between these plate-like fins are used as heat-medium-guiding grooves. Even extremely narrow grooves can be easily formed by setting the intervals at which the plate-like fins are formed in an upright manner. Also, a container in which grooves are integrally formed can be easily manufactured by forming the grooved metal plate into a substantial plate shape. Furthermore, it is possible to reduce costs because the container of the plate-type heat exchanger can be formed from a metal plate. Moreover, copper or another arbitrary metal plate having good thermal conductivity can be used as the material for the container. Since grooves having an arbitrary width can be formed without affecting this material, the optimum metal material can be freely used according to the intended use of the plate-type heat exchanger.

When a carving tool having a blade is used to form grooves between plate-like fins by carving down into the surface portion of the metal plate, the bottoms of the grooves can be substantially rectangular in cross section. One of the inset corners of the grooves can also be formed at an acute angle by using the carving tool blade. Since this acute-angled inset corner in the bottom increases the capillary force, it is even easier to manufacture a plate-type heat exchanger comprising heat-medium-guiding grooves capable of transferring a sufficient amount of a heat medium without affecting the set alignment or other such characteristics.

Furthermore, in the present invention, the peaks of the fins are cut away with a cutter or another cutting tool after the fins are formed, and the distal ends of the fins are formed into flat surfaces. As a result, the depths of the grooves can be arbitrarily set, and the optimum plate-type heat exchanger can be manufactured according to the intended use. Also, the plate-type heat exchanger can be reduced in thickness by cutting away the peaks of the fins and forming the distal ends into flat surfaces.

In the present invention, a hoop-type plastic workable metal plate of specific thermal conductivity is prepared;

the steps of forming a specific number of fins in a surface portion of a hoop-type metal plate and transferring the hoop-type metal plate by a specific dimension to the next fin-forming position are alternatively performed;

a fixed-length metal plate in which the fins are formed is cut out from the hoop-type metal plate; and a plurality of grooves between the fins formed in the cut out metal plate is used as heat-medium-guiding grooves.

It is possible to continuously form containers by using a hoop-type metal plate as the metal plate for forming the container. This is achieved by forming fins at fin-forming positions at specific intervals, and forming grooves between the fins. Therefore, it is possible to easily construct a line for continuously manufacturing plate-type heat exchangers by repeating container-forming steps and other steps in which a container is formed to the specific shape. As a result, a plate-type heat pipe, a vapor chamber, or another plate-type heat exchanger can be manufactured at an even lower cost.

Next, in the present invention, the metal plate that has the heat-medium-guiding grooves is used to manufacture a container comprising a communication hole that communicates the hollow part with the exterior;

a heat medium is poured into the hollow part from the communication hole;

the hollow part is vacuum-degassed via the communication hole; and the vacuum-degassed state is maintained while the communication hole is sealed. According to the present invention, after the working fluid is poured into the plate-like container from the communication hole formed in the container, the hollow part is vacuum-degassed via the communication hole, and the communication hole is sealed in this vacuum-degassed state. The hollow part in which the working fluid has been poured can therefore be easily and reliably brought to a vacuum state.

In the present invention, a communication tube that is communicated with the communication hole and that protrudes from the outside surface of the container is formed in the container; and after a heat medium is poured into the hollow part through the communication hole and the hollow part is vacuum-degassed via the communication hole, the base portion of the communication tube is crushed to cut away the communication tube so that the communication hole is sealed while the vacuum-degassed state is maintained. The communication hole can thus be sealed by means of a simple operation.

Furthermore, in the present invention, a first metal plate and a second metal plate for configuring the container that comprises the hollow part are prepared; a communication groove for forming the communication hole is formed in at least one side of the joining surface between the first and second metal plates; the first and second metal plates are superposed to make the joining surface airtight, and the hollow part that is communicated with the exterior via the communication hole is formed; and after a heat medium is poured into the hollow part through the communication hole and the hollow part is vacuum-degassed via the communication hole, the joining surface portion of the first and second metal plates is pressed in the thickness direction to seal the communication hole while the vacuum-degassed state is maintained. The communication hole can be sealed by means of a simple operation in this case as well.

SYMBOLS

Figure 1:
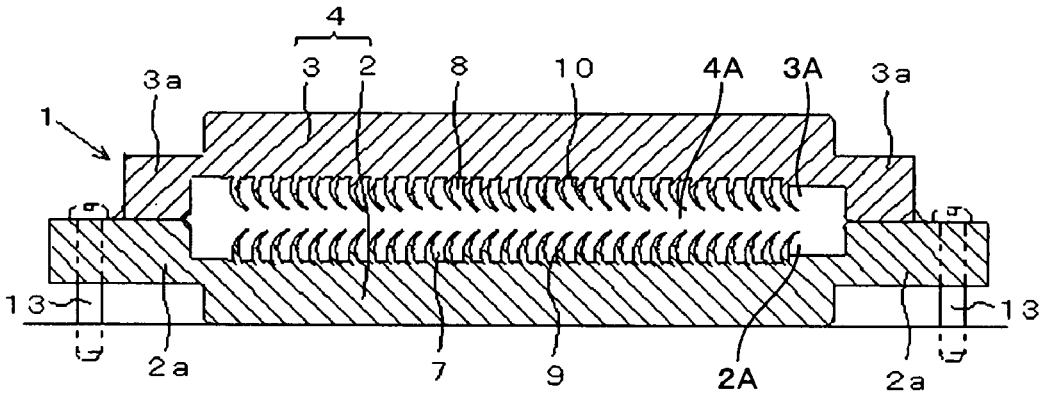
FIG. 1 is a cross-sectional view depicting a plate-type heat pipe according to Embodiment 1 of the present invention.

1 plate-type heat pipe
2 bottom container
2*a* flange
3 top container (sealing member)
3*a* flange
3*d* sealing member
4 container
5 evaporating part
6 condensing part
7, 8 grooves
9, 10 fins
20 metal plate
30 carving tool
31 blade
50 hoop-type metal plate
60 fin
61 groove

BEST MODE FOR CARRYING OUT THE INVENTION

Embodiments of a plate-type heat exchanger in which the present invention is applied will now be described with reference to the diagrams. In the following embodiments, a plate-type heat pipe is described as an example of a plate-type heat exchanger, but it is of course also possible to similarly apply the present invention to a vapor chamber.

Embodiment 1

Figure 2:
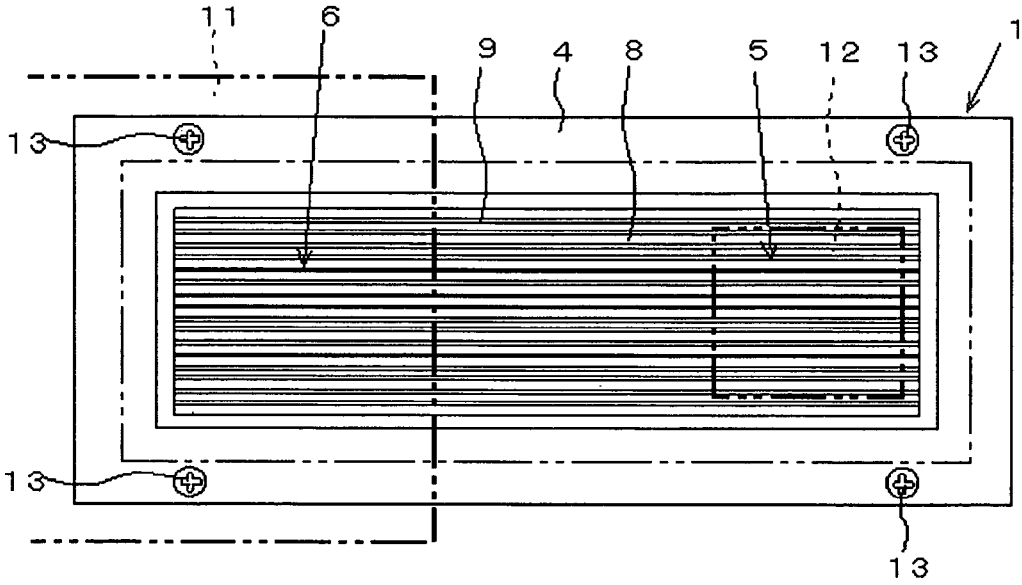
FIG. 2 is a plan view depicting the plate-type heat pipe in FIG. 1.

FIG. 1 is a cross-sectional view depicting a plate-type heat pipe according to Embodiment 1, and FIG. 2 is a plan view depicting the plate-type heat pipe. A plate-type heat pipe 1 has a working fluid (heat medium) sealed in a hollow part 4A having an airtight structure formed in the interior of a flat, rectangular container 4, and also has grooves 7, 8 formed as heat-medium-guiding grooves in the container's inside surface portions that face the hollow part 4A. The grooves 7, 8 are formed between a condensing part 6 and an evaporating part 5 in the hollow part 4A, and the working fluid is moved along the grooves 7, 8 from the condensing part 6 to the evaporating part 5 by capillary force, resulting in heat radiation.

The plate-type container 4 comprises a rectangular bottom container (container main body) 2, and a slightly smaller rectangular top container 3 (container lid) that is placed over the bottom container 2. The container is formed by bonding and sealing the open end faces, which are the joining surfaces of these rectangular frames. The bottom container 2 and the top container 3 are formed into substantial plate shapes having rectangular concavities 2A, 3A enclosed by the joining surfaces shaped as rectangular frames. The grooves 7, 8 are formed in the inside surface portions of the bottom container 2 and top container 3 that face the concavities 2A, 3A, in a manner that connects the evaporating part 5 with the condensing part 6. The working fluid sealed in the hollow part 4A of the container 4 can be water, an alternative chlorofluorocarbon, acetone, methanol, helium, nitrogen, ammonia, Dowtherm A, naphthalene, sodium, or the like.

Also, flanges 2*a*, 3*a* comprising open end faces shaped as rectangular frames are formed in the bottom container 2 and the top container 3. These open end faces are superposed over each other. In this state, the outer peripheral edges of the flanges 2*a*, 3*a* are sealed by welding, soldering, adhesion, or another sealing means.

The bottom container 2 and the top container 3 are formed from a metal material having good thermal conductivity, such as aluminum, an aluminum alloy, copper, a copper alloy, or stainless steel. The grooves 7, 8 formed in the inside surface portions of the bottom container 2 and top container 3 are formed between plate-shaped fins 9, 10. The fins are formed in an upright manner by carving out the metal material of the container itself with the blade of a carving tool to be described later.

Figure 3:
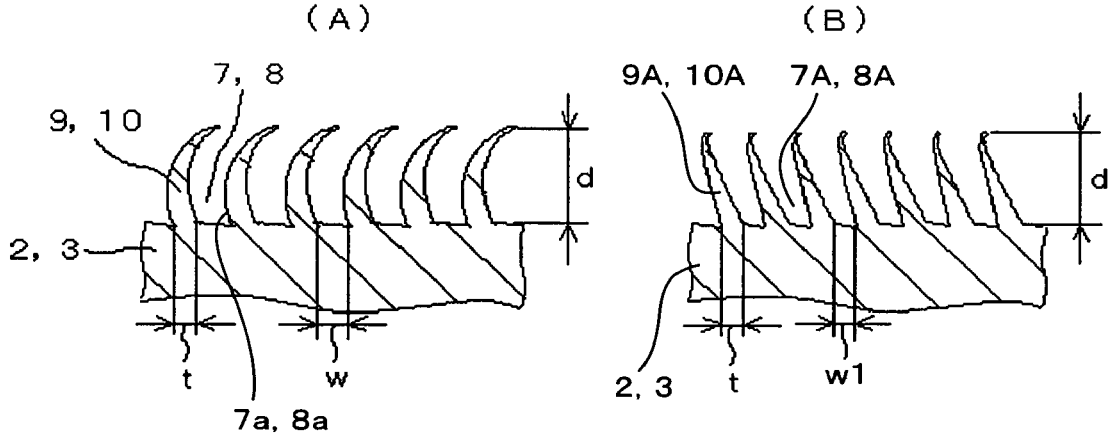
FIGS. 3(A) and 3(B) are partial enlarged cross-sectional views depicting grooves in the plate-type heat pipe.

FIG. 3(A) is a partial enlarged cross-sectional view depicting the grooves 7, 8. As shown in this diagram, multiple grooves 7, 8 are in a substantially rectangular shape in cross section, creating strong capillary force. Inset corners 7*a*, 8*a* of at least one of the grooves 7, 8 are formed at acute angles, as can be seen from the diagram. If the corners are thus formed at acute angles, the capillary force can be further increased.

The thickness t of the fins 9, 10 is 0.1 to 1 mm, and the width w of the bottom surfaces of the grooves 7, 8 is set to from 0.01 to 1.0 mm to create sufficient capillary force. Also, the depth d of the grooves 7, 8 is set to from 0.1 to 1.0 mm. The thickness of the containers 2, 3 in the bottom surfaces of the grooves 7, 8 is set to from 0.1 to 1.0 mm.

The cross-sectional shapes of the grooves 7, 8 are rectangular shapes that curve in the same direction. This is because the fins 9, 10 are formed into somewhat curved shapes when the metal material of the containers 2, 3 is carved out with the carving tool blade. Since the grooves 7, 8 are formed between the fins 9, 10, the cross-sectional shapes of the grooves 7, 8 are necessarily determined by the cross-sectional shapes of the fins 9, 10.

FIG. 3(B) is a partial enlarged cross-sectional view depicting a modification of the fins 9, 10. The fins 9A depicted in this diagram are formed in a shape that is more similar to flat plate shapes than the fins 9, 10 depicted in FIG. 3(A). The fins 9A can be formed in various shapes depending on the shape of the carving tool blade or the carving angle. The fins 9A formed by the carving tool blade gradually decrease in thickness from the bases on the side of the containers 2, 3 towards the distal ends. Accordingly, the cross-sectional shapes of the grooves 7A gradually increase in width w1 from the bottom surfaces towards the open ends.

The plate-type heat pipe 1 is attached by screws 13 to the interior of a notebook personal computer, for example, as shown in FIG. 2. The condensing part 6 of the container 4 is bonded to a metal heat-radiating member 11 included inside the case of the personal computer, for example. The evaporating part 5 of the container 4 is disposed in a thermally conductive state on the top surface of a CPU 12.

Next, FIGS. 4 through 8 are explanatory diagrams depicting a method for manufacturing the plate-type heat pipe 1 having the configuration described above. The metal material used in the bottom container 2 and the top container 3 constituting the container 4 of the plate-type heat pipe 1 is a plastic workable metal that has good thermal conductivity. Possible examples include aluminum, an aluminum alloy, copper, a copper alloy, stainless steel, and other materials. Also, a metal plate having the thickness and width necessary to form the containers 2, 3 is used. First, the method for manufacturing the bottom container 2 will be described.

Figure 4:
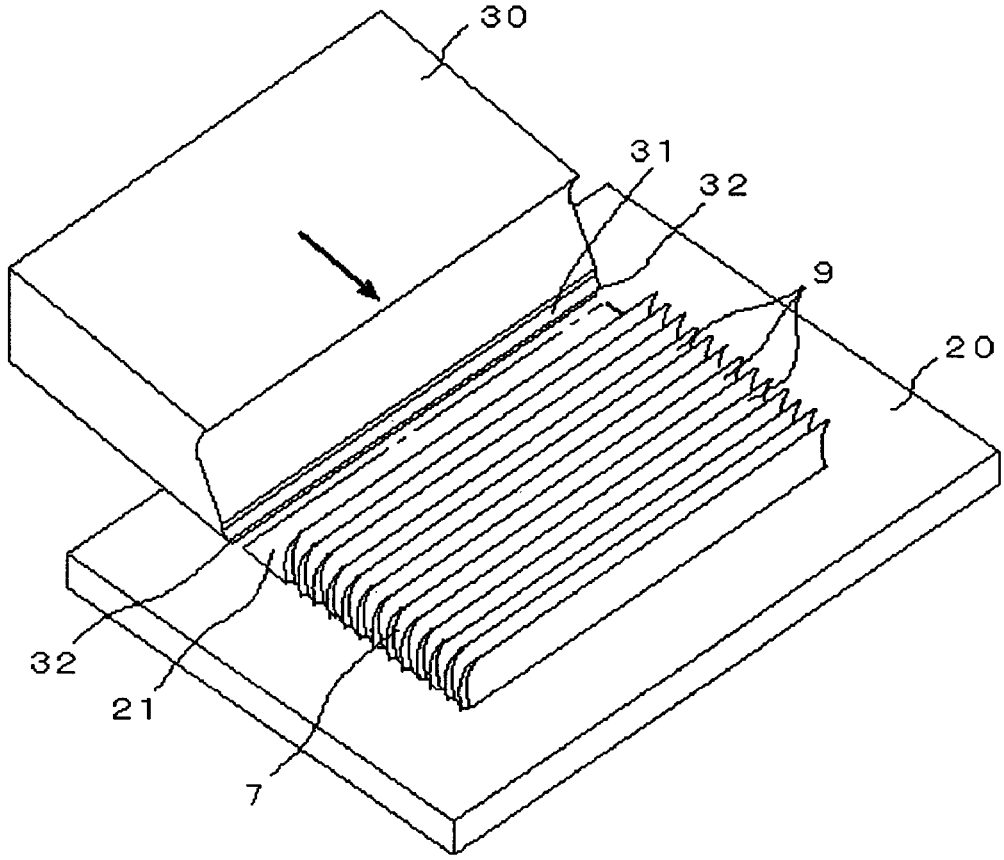
FIG. 4 is a perspective view depicting the process of forming grooves in the plate-type heat pipe in FIG. 1.
Figure 5:
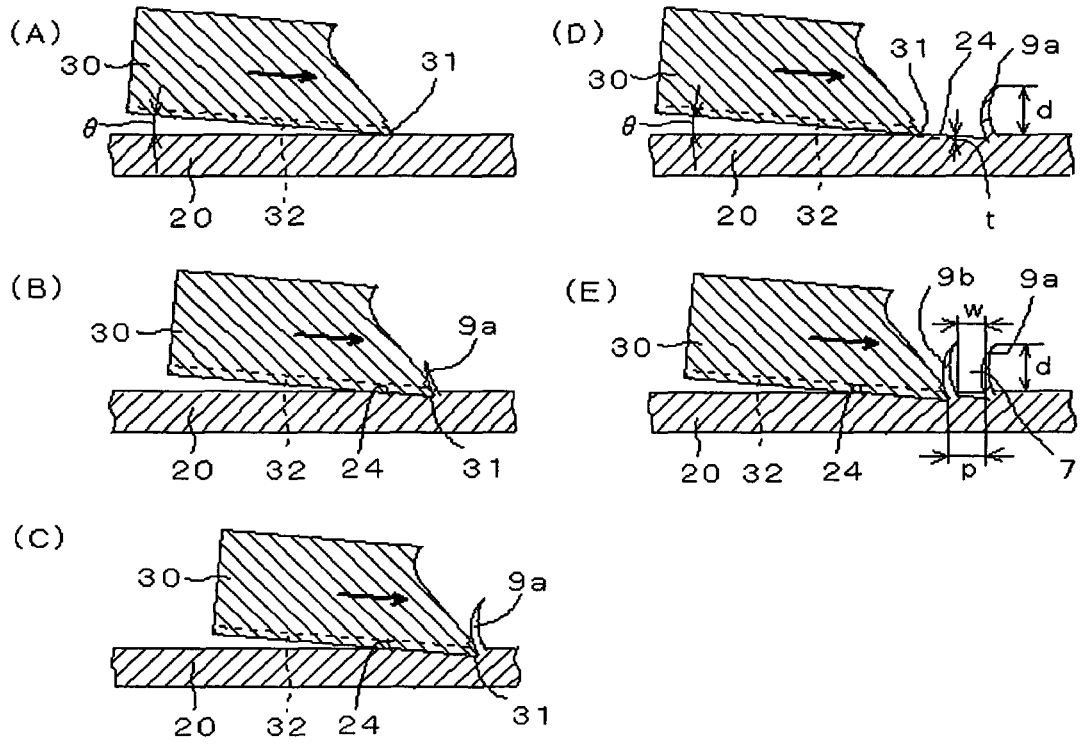
FIGS. 5(A) through 5(E) are explanatory diagrams depicting the process of forming grooves in the plate-type heat pipe in FIG. 1.
Figure 6:
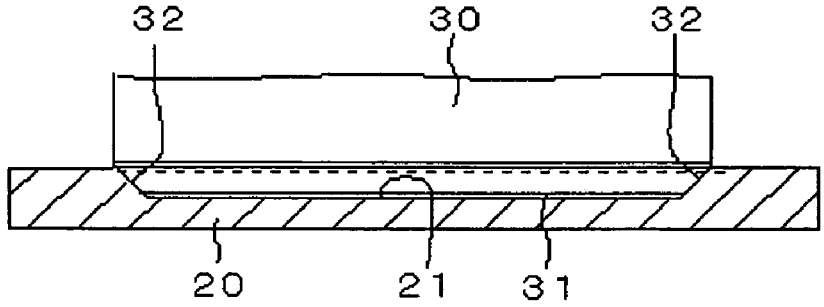
FIG. 6 is an explanatory diagram depicting the manner of carving out a metal plate with a carving tool in the groove forming process.

As shown in FIGS. 4 and 5, a carving tool 30 for forming the fins 9, 10 has a blade 31 formed at the distal end of the bottom side. Furthermore, blades 32 having tapered shapes are formed at both sides of the bottom surface, as shown in FIG. 6. The carving tool 30 is tilted towards the metal plate 20 at a specific angle θ so that the back end side is raised, and is attached to a drive device (not shown). The angle θ of incline of the carving tool 30 is appropriately set according to the height and thickness of the fins 9, the material of the metal plate 20, and other factors, and is set to approximately from 5 degrees to 20 degrees.

Figure 7:
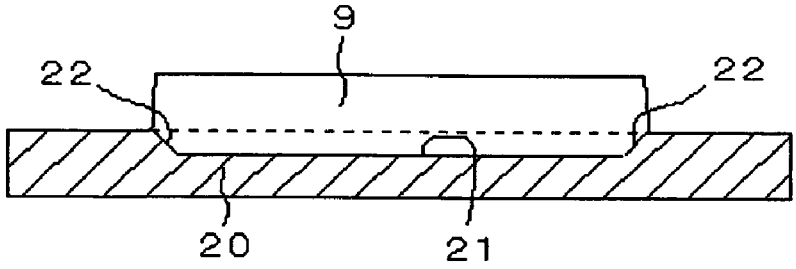
FIG. 7 is a cross-sectional view depicting a groove and a fin.
Figure 8:
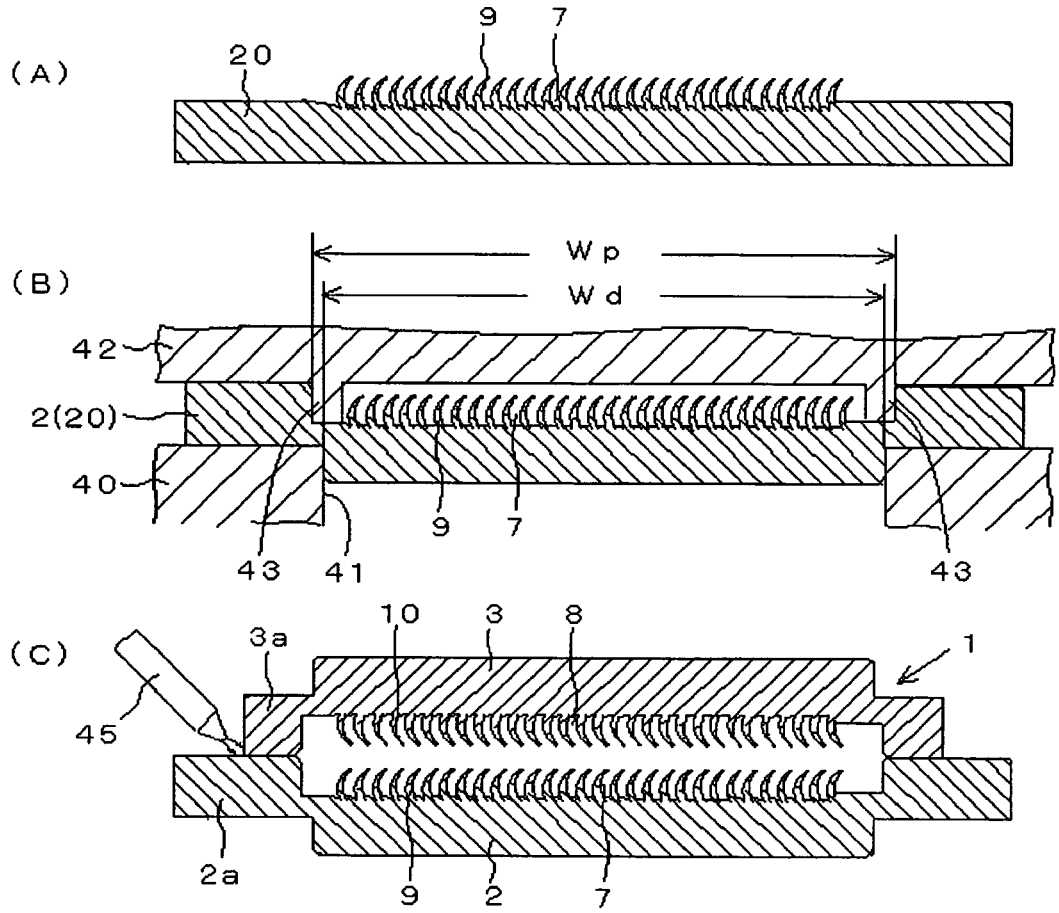
FIGS. 8(A) through 8(C) are explanatory diagrams depicting the process of manufacturing the plate-type heat pipe in FIG. 1.

First, the metal plate 20 is positioned and placed on a die (not shown). As shown in FIG. 5(A), the carving tool 30 is brought into contact with the surface portion of the metal plate 20, and then the carving tool 30 is driven by a drive device (not shown) to move towards the opposite side of the metal plate 20 at a specific angle. The metal plate 20 is then carved out by the blade 31 at the distal end of the carving tool 30, and the distal end of a thin fin 9 is formed in an upright manner, as shown in FIG. 5(B). When the carving tool 30 is moved further to a specific position, the metal plate 20 is carved out gradually deeper, and a first fin 9*a* is formed with a specific height d, as shown in FIG. 5(C). Also, when the metal plate 20 is carved out, the tapered blades 32 at both distal ends of the carving tool 30 cut out the walls of a concavity 21 as shown in FIG. 6, and tapered surfaces 22 are formed in the walls of the concavity 21 as shown in FIG. 7. Furthermore, a machined surface 24 is formed in the concavity 21 as a result of carving out the first fin 9*a*. After the first fin 9*a* is formed, the carving tool 30 is retracted and returned to a standby position.

After the first fin 9*a* is formed as described above, the next second fin 9*b* is formed. At this time, the metal plate 20 is moved downstream to the right in the diagram by a specific pitch, and is positioned and fixed in place on the die. The blade 31 of the carving tool 30 is then brought into contact with the metal plate upstream of the machined surface 24, as shown in FIG. 5(D). This contact position is set to a position whereby a specific carving margin t can be obtained in the machined surface 24. Incidentally, the carving margin t is set to from about 0.01 mm to 0.5 mm.

Then, the carving tool 30 is moved by a specific angle towards the opposite side of the metal plate 20, and the blade 31 of the carving tool 30 is moved to a position having a specific pitch p to carve out the metal plate 20, whereby a thin second fin 9*b* is formed in an upright manner, as shown in FIG. 5(E). A concavity 21 is thereby formed in the metal plate 20, and the machined surface 24 is formed inside this concavity 21. The carving tool 30 is again retracted and returned to the standby position.

Thus, a groove 7 is formed between the first fin 9*a* formed initially, and the second fin 9*b* formed next. This groove 7 is formed so that the bottom has a substantially rectangular shape in cross section. Furthermore, the corner of the groove 7 in the right side of the diagram is formed into an acute angle. The angle of this corner is formed to be less than 90 degrees, which is substantially equal to the angle of the blade 31 of the carving tool 30.

The fins 9*a*, 9*b* are formed in a thickness of 0.1 to 1 mm, and the width w of the groove 7 in the bottom is set according to the position where the carving tool 30 stops when the second fin 9*b* is formed after the first fin 9*a* is formed. The width w of the groove 7 is set to from 0.01 to 1.0 mm, which is necessary to create sufficient capillary force. Also, the depth d of the groove 7 is set to from 0.1 to 1.0, which is equal to the height of the fins 9. The thickness of the bottom of the groove 7 is reduced as a result of the metal plate 20 being deeply carved out by the carving tool 30, and is set to from 0.1 to 1.0 mm. The bottom of the groove 7 is formed by the concavity 21.

Furthermore, to form multiple fins 9 in an upright manner and to form multiple grooves 7 in the metal plate 20, the carving tool 30 is moved to form fins 9 at a specific pitch. In other words, this process is repeated so that the metal plate 20 is moved downstream and is positioned and fixed in place on the die, and then the carving tool 30 is moved to form the fins 9 in an upright manner. Thereby, the fins 9 are formed continuously at a specific pitch in the metal plate 20, and the grooves 7 having a specific width w are formed continuously, as shown in FIG. 8(A).

The top container 3 formed into a substantial plate shape having concavities is formed in the following process from the metal plate 20 provided with grooves 7 on one side as described above. The metal plate 20 shown in FIG. 8(A) is positioned and mounted on a die 40 that is set on the fixed side of a pressing machine. A hole 41 is formed in the die 40, and this hole has a specific open area that is substantially the same as that of the region in which the grooves 7 are formed. A punch 42 set on the moving side of the pressing machine applies pressure to one side of the metal plate 20. The punch 42 is provided with a pier 43 that applies pressure to the periphery around the grooves 7. The outside dimension Wp of the pier 43 is set to be greater than the inside dimension Wd of the hole 41 in the die 40, and the outer edge side of the pier 43 is made to face the open periphery of the hole 41. The metal plate 20 around the opening is thereby crushed when the punch 42 is lowered, whereby it is possible to prevent shearing of the metal plate 20 in advance. Such shearing tends to occur when the metal plate is pressed and formed into a substantial plate shape. It is preferable that a knockout for pushing and urging the die 40 into the metal plate 20 be provided in the hole 41 of the die.

The bottom container 2 having a substantial plate shape is formed, as shown in FIG. 8(B), by lowering the punch 42 from one side of the metal plate 20 placed on the die 40, and applying pressure. A flange 2*a*, whose open side is flat, is formed in the outer periphery of the bottom container 2. The flange 2*a* may be formed somewhat larger than the desired dimensions, and the outer periphery may subsequently be cut off to the specific dimensions after the bottom container 2 is formed into a substantial plate shape.

Next, the method for manufacturing the top container 3 will be described. The top container 3 is formed in the same manner as the bottom container 2. Specifically, as is also done in the method of forming the bottom container 2, the step of moving the carving tool 30 and forming fins 10 in an upright manner is repeated, whereby the fins 10 are formed continuously at a specific pitch in the metal plate 20 as shown in FIG. 8(A), and the grooves 8 having a specific width are also formed continuously.

The metal plate 20 is positioned and mounted on the die 40 that is set on the fixed side of the pressing machine, similar to the bottom container 2, and the punch 42 set on the moving side of the pressing machine applies pressure to one side of the metal plate 20, forming the substantially plate-shaped top container 3. A flange 3*a* whose open side is flat is formed around the outer periphery of the top container 3. The outside dimensions of the flange 3*a* are made smaller than those of the bottom container 2.

The open end of the flange 3*a* of the top container 3 is superposed over the open end of the flange 2*a* of the bottom container 2 formed as described above; a vacuum is created in the interior; a suitable amount of water, substitute chlorofluorocarbon, acetone, methanol, helium, nitrogen, ammonia, Dowtherm A, naphthalene, sodium, or the like is sealed in as the working fluid; and the flanges 2*a*, 3*a* are then bonded together. The outer peripheral edges of the flanges 2*a*, 3*a* are then sealed by a welding machine 45, as shown in FIG. 8(C). As a result, a plate-type heat pipe 1 is obtained. The distal ends of the fins 9 of the bottom container 2, and the distal ends of the fins 10 of the top container 3, are separated by a specific dimension, as shown in FIG. 8C. Soldering, adhesion, or the like can also be used as the sealing means in addition to welding.

As described above, when the carving tool 30 is used to form the fins 9 in the bottom container 2 and top container 3 in an upright manner and to form the grooves 7, a concavity 21 is formed in one surface portion of the metal plate 20. The thickness from the outer surfaces of the bottom container 2 and top container 3 to the bottom surfaces of the grooves 7 is thereby reduced. Therefore, the heat generated from the CPU 12 bonded to the evaporating part 5 is quickly transferred, making it possible for the working fluid to be vaporized. It is also possible for the heat to be quickly transferred to the heat-radiating member 11 in the condensing part 6 to condense the working fluid.

Modifications of Embodiment 1

Figure 9:
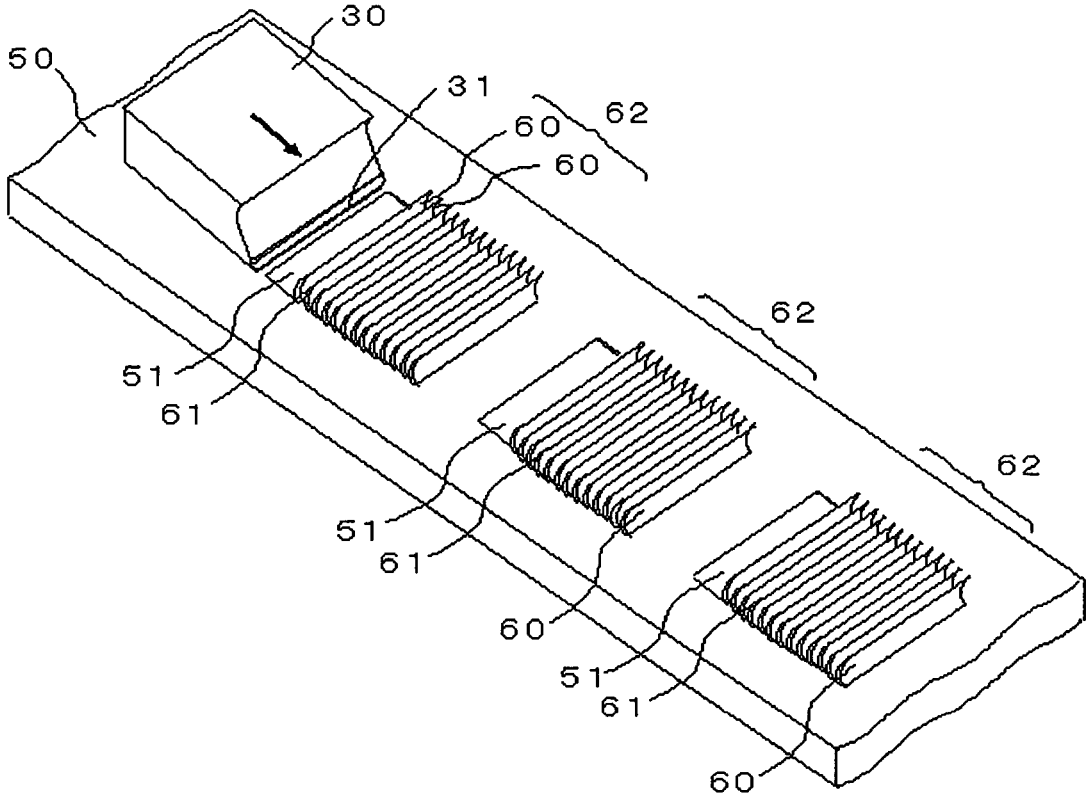
FIG. 9 is a perspective view depicting the groove forming process whereby grooves are formed in a hoop-type metal plate.

A hoop-type metal plate made of aluminum, an aluminum alloy, copper, a copper alloy, stainless, steel, or the like can be used instead of the metal plate 20. Specifically, a hoop-type metal plate 50 is mounted while being positioned on a die (not shown) as shown in FIG. 9. One surface of the hoop-type metal plate 50 is then carved out by the blade 31 of the above-described carving tool 30 to form fins 60 of a specific height in an upright manner.

The hoop-type metal plate 50 is then moved by a specific pitch and is positioned and fixed in place on the die. After the blade 31 of the carving tool 30 is brought into contact at a position that is upstream of the machined surface 51 and that produces a specific carving margin, the carving tool 30 is moved at a specific angle towards the other side of the hoop-type metal plate 50 to a position that produces a specific pitch, and carves out the hoop-type metal plate 50 to form the next thin fin 60 in an upright manner at a position separated from the previously formed fin 60 by a specific pitch.

Thus, a groove 61 is formed between the previously formed fin 60 and the newly formed fin 60. This groove 61 is formed so that the bottom has a substantially rectangular shape in cross section. Furthermore, the corner of the groove 61 has an acute angle. The angle of this corner is less than 90 degrees and is substantially equal to the angle of the blade 31 of the carving tool 30.

The process of forming the grooves is repeated until a specific number of grooves 61 are formed at specific locations on the hoop-type metal plate 50. At this time, the width obtained when a specific number of grooves 61 are formed can be kept constant by keeping the intervals between fins 60 to a highly precise pitch. After a groove cluster 62 composed of a specific number of grooves 61 is formed, the hoop-type metal plate 50 is moved a specific distance to the position where the next groove cluster 62 is to be formed, a specific number of fins 60 are formed in an upright manner by the carving tool 30 in the same manner as described above, and the next groove cluster 62 is formed to obtain a specific number of grooves 61 between the fins 60. This groove forming process is repeated in sequence.

After such groove clusters 62 are formed at specific intervals in this manner, cuts are made along the cutting lines between the groove clusters 62, and metal plates are formed in the same manner as the metal plate 20 shown in FIG. 8(A). This cutting process may be performed immediately after a single groove cluster 62 is formed, or after multiple groove clusters 62 are formed. The metal plate provided with the grooves 61 is then formed into a substantial plate shape as shown in FIGS. 8(B) and 8(C). The process by which the metal plate is formed into a substantial plate shape may be performed while the metal plate is still in the form of the hoop-type metal plate 50, and then the cuts may be made at the specific cut lines.

Next, in the plate-type heat pipe 1 shown in FIG. 1, a gap is formed between the flange 2*a* and the heat-radiating member 11 in a state in which the flange 2*a* formed around the bottom container 2 is attached to the heat-radiating member 11. The thermal conductivity can be increased if this gap is eliminated. The example depicted in FIGS. 10 and 11 is configured with no such gap.

Figure 10:
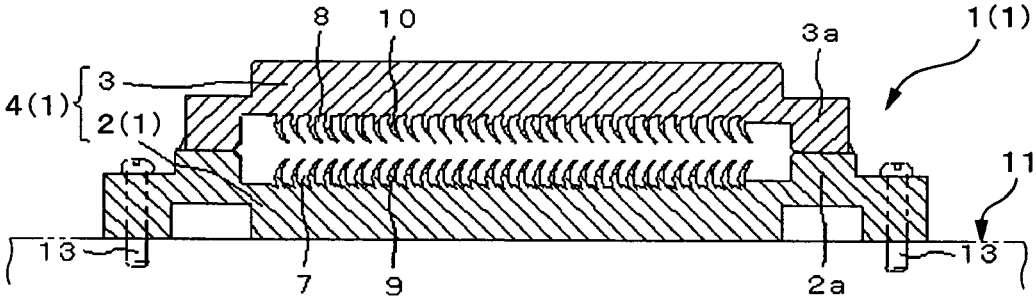
FIG. 10 is a cross-sectional view depicting a modification of the plate-type heat pipe.

First, in the container 4(1) of the plate-type heat pipe 1(1) depicted in FIG. 10, the bottom surface of the flange 2*a* of the bottom container 2(1) is formed so as to be part of the same surface as the bottom surface of the region where the grooves 7 are formed. Only the portion that joins to the flange 3*a* of the top container 3 protrudes in a rectangular frame shape towards the top container 3. If the container 4(1) whose bottom surface has thus been made flat is attached to the heat-radiating member 11 by screws 13, the attachment can be firmly secured, and the contact surface area with the heat-radiating member 11 can be increased, allowing thermal conduction to be improved.

Figure 11:
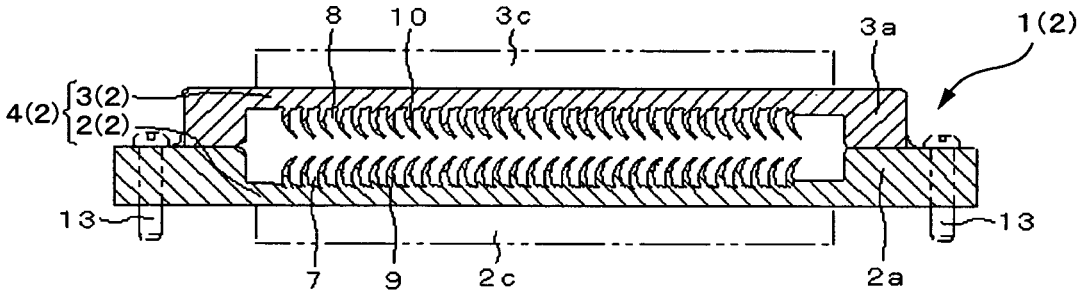
FIG. 11 is a cross-sectional view depicting a modification of a plate-type heat pipe.

In the container 4(2) of the plate-type heat pipe 1(2) depicted in FIG. 11, the bottom surface of the bottom container 2(2) and the top surface of the top container 3(2) lie in different planes. The bottom container 2(2) is manufactured in the following manner, for example. A substantially plate-shaped bottom container, having a concavity in which grooves 7 are formed in the inner surface, is formed according to the method depicted in FIG. 8 as previously described. This bottom container has a protruding part 2*c* formed in the bottom surface that faces the concavity. The protruding part 2*c* is cut off with a cutting means, and a bottom container 2(2) is obtained in which the bottom surface lies along the same surface as the flange 2*a*. The means for cutting off the protruding part 2*c* can be a cutter or a milling cutter, or cut machining using a grinder can be employed. As a result, the bottom surface that faces the concavity can be made thinner, and thermal conduction between the evaporating part 5 and the condensing part 6 can be improved.

The top container 3(2) can be manufactured in the same manner. Specifically, a protruding part 3*c* formed in the top surface that faces the concavity in which the grooves 8 are formed in the inner surface can be removed by cutting, and the top surface can be made to lie along the same surface as the flange 3*a*.

Thus, the plate-type heat pipe 1(2) itself can be made thinner by removing the protruding parts 2*c*, 3*c* formed in the bottom container and the top container, and flattening out the entire surfaces. Moreover, thermal conduction can be improved because the intervals between the grooves 7, 8 that face the evaporating part 5 and condensing part 6 of the bottom container 2(2) and top container 3(2) can be made smaller.

Figure 12:
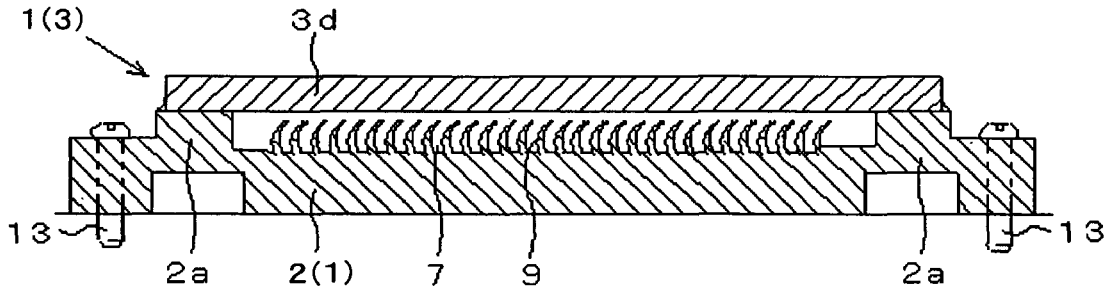
FIG. 12 is a cross-sectional view depicting a modification of a plate-type heat pipe.

Next, the container 4(3) of the plate-type heat pipe 1(3) shown in FIG. 12 has a configuration in which a sealing member 3*d* composed of a flat metal plate is placed over the open end face of the flange 2*a* of the bottom container 2(1) in the same shape as the example depicted in FIG. 10. In the bottom container 2(1) grooves 8 are formed in the inner surface of a concavity formed into a substantial plate shape, and the flange 2*a* whose open side is flat is formed around the outer periphery, as described above. Also, the height of the fins 9 that form the grooves 8 is less than the depth of the concavity. A sealing member 3*d* is placed over the open end of the flange 2*a* of the bottom container 2, a vacuum is formed in the interior, a suitable amount of working fluid is sealed inside, and the outer peripheral edge of the sealing member 3*d* and the flange 2*a* of the bottom container 2 are sealed by a welding device, forming an airtight structure in the interior. At this time, the distal ends of the fins 9 are separated from the inner surface of the sealing member 3*d*. The working fluid flows through this gap as a vapor flow, and the working fluid that has been brought back to a liquid state is moved to the evaporating part by the capillary phenomenon of the grooves 7.

Thus, if the flat sealing member 3*d* is placed over the bottom container 2(1) to form an airtight structure in the interior, the plate-type heat pipe 1(3) can be made thinner. The plate-type heat pipe 1(3) in this example has grooves 8 formed only on the bottom container 2(1). There is therefore a reduction in the feed rate of the working fluid that has been brought back to the liquid state, but the functionality is not reduced because the grooves 8 have sufficient capillary force. Also, because of the large capillary force of the grooves 8, the functionality of the grooves is not reduced even if the alignment of the plate-type heat pipe 1(3) is changed.

Figure 13:
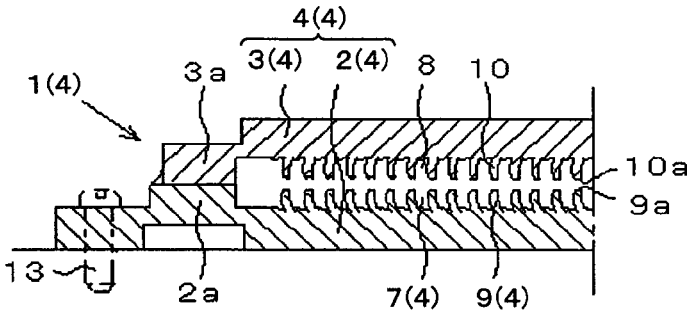
FIG. 13 is a partial cross-sectional view of a modification of the plate-type heat pipe, and explanatory diagrams depicting the groove forming process.
Figure 13:
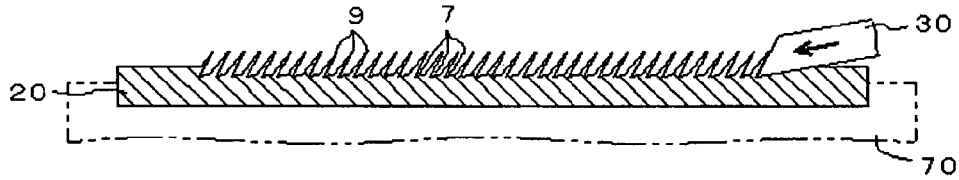
Figure 13:
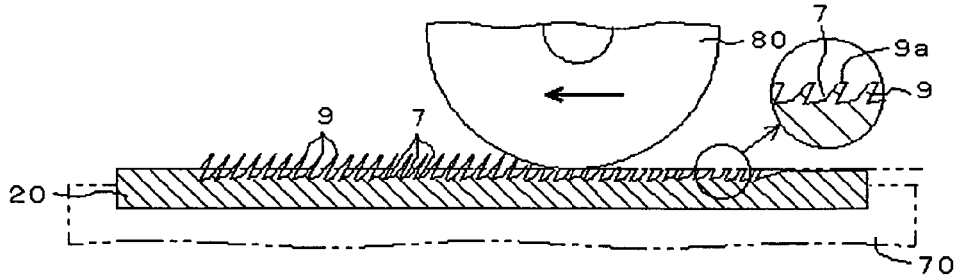

FIG. 13(A) depicts a modification of the grooves formed in the inner surfaces of the bottom container and the top container. The difference between the plate-type heat pipe 1(4) depicted herein and the plate-type heat pipes 1(1), 1(2), 1(3) previously described is that the depth of the grooves is different. Specifically, in the plate-type heat pipe 1(4), the fins 9(4), 10(4) are cut off at the distal ends to form flat surfaces. As a result, the grooves 7(4), 8(4) are substantially square in cross section, and are smaller in depth.

FIGS. 13(B) and 13(C) depict a method for forming the grooves 7(4), 8(4). First, after the metal plate 20 is mounted in a state of being positioned on a die 70 as shown in FIG. 13(B), multiple fins 9 having a specific height are formed together with grooves 7 between the fins 9 by repeating the process of carving out one surface of the metal plate 20 with the carving tool 30. The peaks of the fins 9 formed in one surface of the metal plate 20 are then cut off by a cutter 80 or another cutting tool, for example, to form the fins 9(4) whose distal ends are flat surfaces 9*a*, as shown in FIG. 13(C). Then, the metal plate 20 is formed into a substantial plate shape having a concavity with grooves 7(4) formed in the inner surface according to the method shown in FIG. 8, creating the bottom container 2(4). The top container 3(4) is also formed in the same manner as the bottom container 2(4).

The heights of the fins 9(4), 10(4) formed in the bottom container 2(4) and the top container 3(4) are set to be approximately equal to the depth of the concavity. Therefore, the depths of the grooves 7(4), 8(4) are also approximately equal to the depth of the concavity. The depths of the grooves 7(4), 8(4) can be arbitrarily set by appropriately setting the positions at which the fins 9(4), 10(4) are cut. It is also possible to partially change the depths of the grooves 7(4), 8(4) as necessary.

Thus, cutting off the distal ends of the fins 9(4), 10(4) with a cutter or another cutting tool, for example, and forming flat surfaces 9*a*, 10*a*, makes it possible to arbitrarily set the depths of the grooves 7(4), 8(4), and to form optimum grooves. Also, the plate-type heat pipe 1(4) can be made thinner by reducing the heights of the fins 9(4), 10(4).

Figure 14:
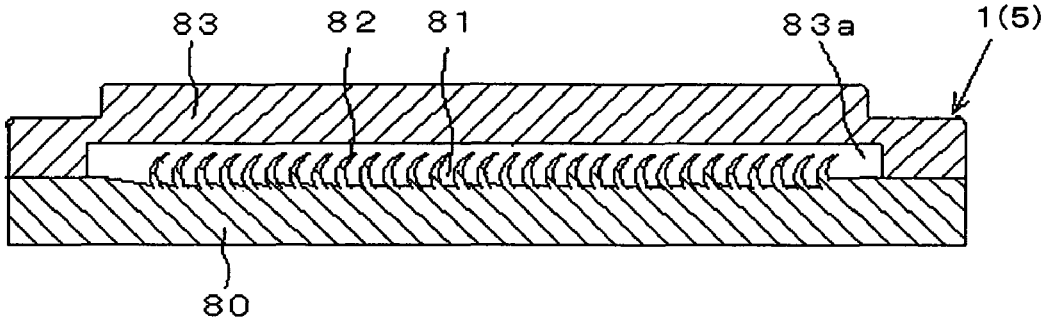
FIG. 14 is a partial cross-sectional view depicting a modification of the plate-type heat pipe.

FIG. 14 depicts another modification of the plate-type heat pipe 1. The container 4(5) of the plate-type heat pipe 1(5) depicted in this diagram is configured from a plate-type bottom container 80 and a substantially plate-shaped sealing member 83. The bottom container 80 is formed into a plate shape, and grooves 81 are formed in one surface of the flat metal plate that constitutes the inner surface of the container 80. The sealing member 83, which is formed into a substantial plate shape, is placed over the inner surface side of the container 80 in which the grooves 81 are formed. The distal ends of multiple fins 82 used to form the grooves 81 are separated from the inner ends of the sealing member 83.

The plate-like container 80 is formed according to the method in FIG. 8(A) as previously described. Therefore, the fins 82 protrude past the flat surface around the container 80. The sealing member 83 is formed into a substantial plate shape having a concavity 83*a* by pressing a flat metal plate. The depth of this concavity 83*a* is made greater than the distance from the flat surface around the container 80 to the distal ends of the fins 82, and is set so that the distal ends of the fins 82 are separated from the inner ends of the sealing member 83 when the sealing member 83 is placed thereon. Vacuuming is performed while the sealing member 83 is placed over the bottom container 80, a suitable amount of the working fluid is poured in, and the outer peripheral edge of the sealing member 83 and the outer periphery of the bottom container 80 are sealed together by welding to form an airtight structure in the interior. At this time, the distal ends of the fins 82 are separated from the inner surface of the sealing member 83.

Thus, the flat container 80 can be easily formed by forming the fins 82 in a flat metal plate as previously described. Also, the sealing member 83 can be easily formed from a flat metal plate by press working. Therefore, manufacturing costs can be reduced because the container 80 and the sealing member 83 can be easily formed together. A plate-type heat pipe 1(5) comprising this flat container 80 will exhibit the same effects as the embodiment previously described.

Figure 15:
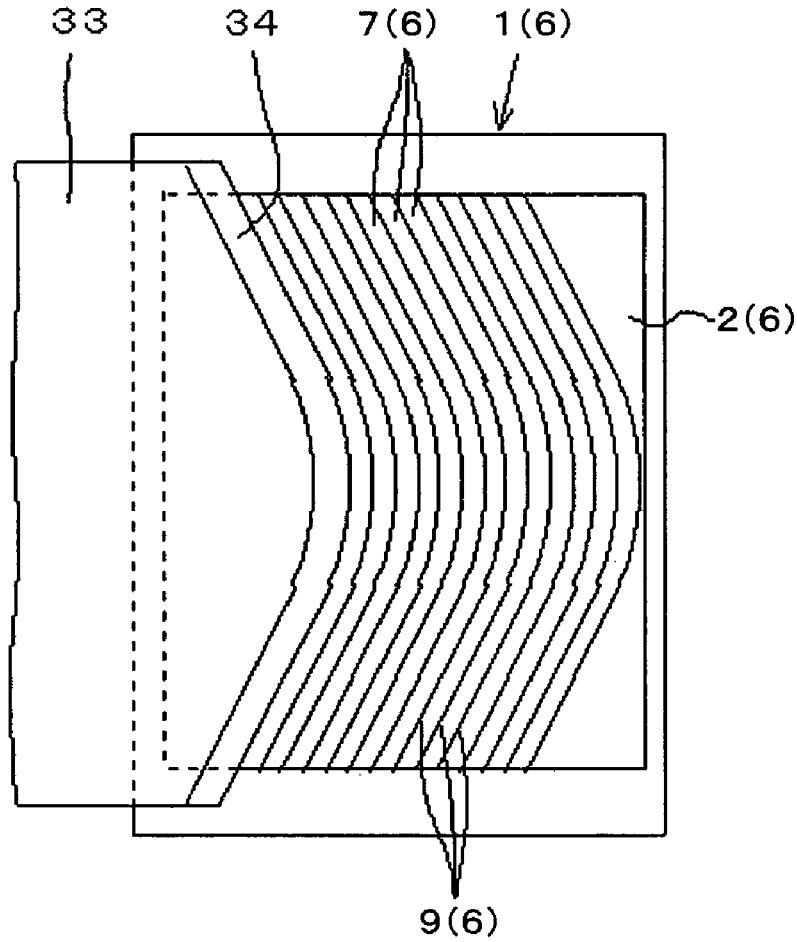
FIG. 15 is a plan view depicting a modification of the plate-type heat pipe.

FIG. 15 depicts another example of a plate-type heat pipe. The plate-type heat pipe 1(6) depicted in this diagram differs from the preceding examples in the shapes of the grooves formed in the inner surfaces of the bottom container and the top container. Specifically, the grooves 7(6) are curved. That is, the fins 9(6) formed in the bottom container 2(6) are formed with a curve, and a substantial plate shape having a concavity with grooves 7(6) formed in the inner surface is then formed according to the above-described method depicted in FIG. 8 resulting in the bottom container 2(6). Although this is not shown, the top container also has fins formed with a curve, similar to the bottom container 2(6).

A carving tool 33 whose distal end is a curved blade 34 as shown in FIG. 15 is used to form the grooves 7(6) with a curved shape. After the metal plate 20 is positioned and mounted on the die, curved fins 9(6) can be formed together with curved grooves 7(6) between the fins 9(6) by repeating the process of carving out one surface of the metal plate 20 with the carving tool 33.

The positions and directions in which the CPU and heat-radiating member are attached with respect to the evaporating part 5 and condensing part 6 in the plate-type heat pipe 1(6) can be varied by forming the grooves 7(6) with a curved shape, and the degree of freedom in designing a personal computer or the like, for example, can be improved.

Figure 16:
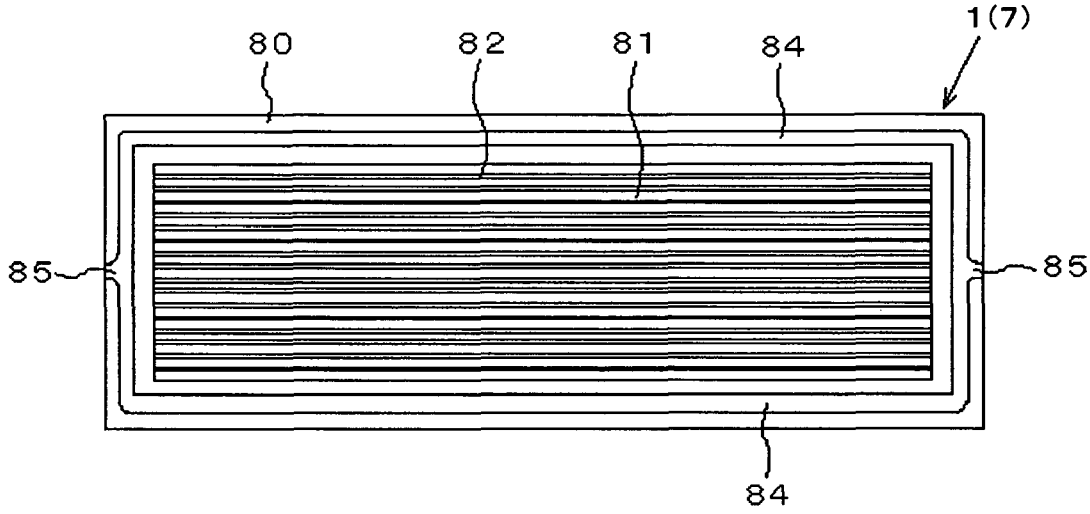
FIG. 16 is a plan view depicting a modification of the plate-type heat pipe.

FIG. 16 depicts an example of a sealing structure for sealing the interior in an airtight structure when the sealing member is placed over the bottom container. The cross-sectional configuration of the plate-type heat pipe 1(7) depicted in this diagram is identical to that of the plate-type heat pipe 1(5) depicted in FIG. 14 described previously. Therefore, corresponding components are denoted by the same numerical symbols.

A flat part is formed in the peripheral edge of the container 80 of the plate-type heat pipe 1(7), and a ring-shaped groove 84 is formed in this flat part. Furthermore, an escape groove 85 is formed to communicate the ring-shaped groove 84 with the outer edge of the bottom container 80.

When the sealing member 83 is placed over the container 80, an adhesive for sealing is poured in advance into the ring-shaped groove 84, and the adhesive entirely fills up the ring-shaped groove 84. The sealing member 83 is then placed over the bottom container 80. The adhesive is filled in the space between the bottom container 80 and the sealing member 83 to seal the two members together. Since excess adhesive flows out to the outer edge of the container 80 from the escape groove 85, it is possible to prevent in advance the space between the container 80 and the sealing member 83 from being raised upward by the adhesive. Although it is possible for the bottom container 80 and the sealing member 83 to be sealed by the adhesive, the bottom container 80 and the outer peripheral edge of the sealing member 83 may also be sealed together by a welding machine as necessary, as shown in FIG. 8(C).

Embodiment 2

Figure 17:
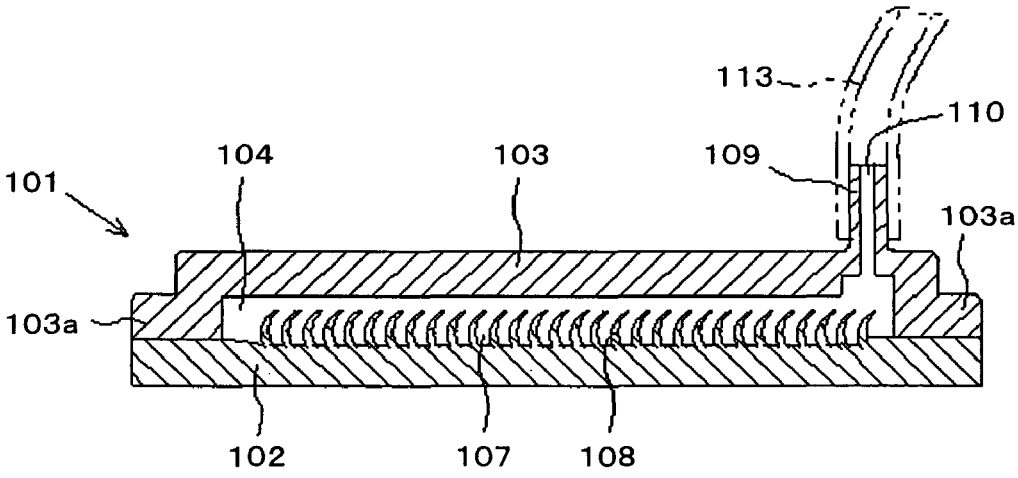
FIG. 17 is a cross-sectional view depicting the plate-type heat pipe according to Embodiment 2 of the present invention.
Figure 18:
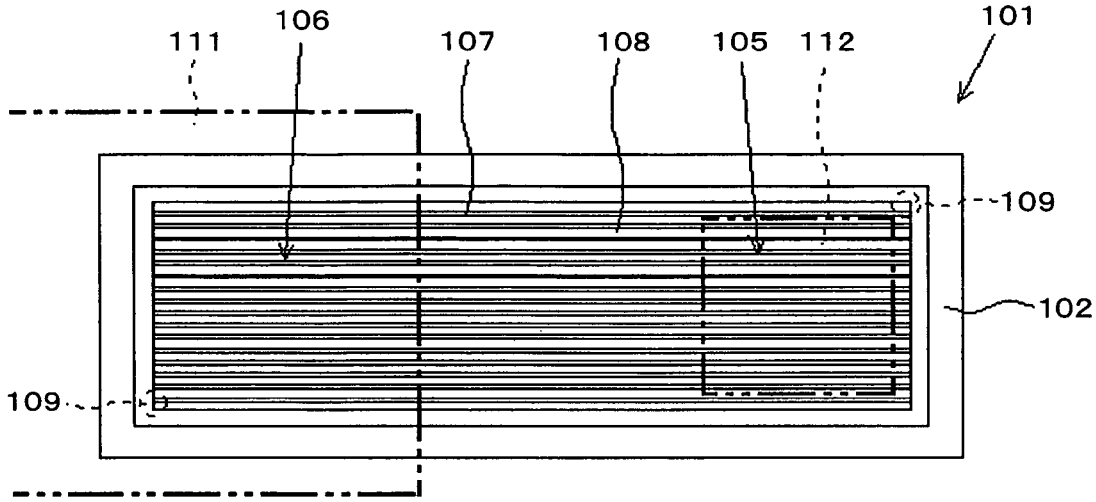
FIG. 18 is a plan view depicting the plate-type heat pipe in FIG. 17.
Figure 19:
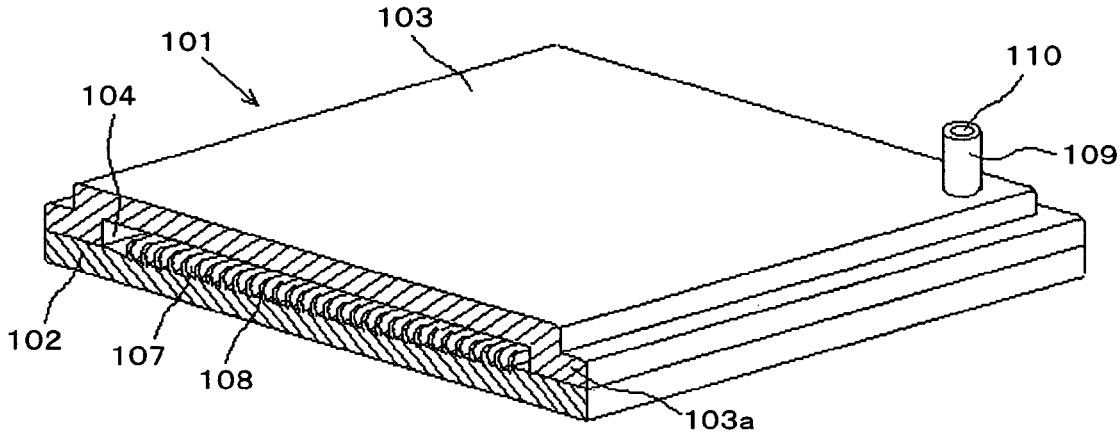
FIG. 19 is a partial cross-sectional perspective view depicting the plate-type heat pipe in FIG. 17.

FIG. 17 is a cross-sectional view depicting a plate-type heat pipe as a liquid-cooled plate-type heat exchanger according to the second embodiment of the present invention, FIG. 18 is a plan view depicting a plate-type heat pipe, and FIG. 19 is a perspective view depicting a plate-type heat pipe in partial cross section.

A container 104 of a plate-type heat pipe 101 comprises a bottom container 102 and a sealing member 103 placed over the bottom container 102, and the container is formed by bonding and sealing the peripheral edges of the top and bottom containers together. A flat hollow part 104A having an airtight structure is formed in the interior of the container 104. The sealing member 103 is formed into a substantial plate shape having a concavity, and grooves 107 that join an evaporating part 105 with a condensing part 106 are formed in the inner surface of the substantially plate-like bottom container 102. A working fluid is sealed inside the hollow part 104A sealed in this manner. The working fluid can be pure water, an substitute chlorofluorocarbon, acetone, methanol, helium, nitrogen, ammonia, Dowtherm A, naphthalene, sodium, or the like.

A flange 103*a* is formed in the sealing member 103 to protrude in the circumferential direction, the flange is joined with the peripheral edge of the bottom container 102, and these bonded outer peripheral edges are sealed by welding, soldering, adhesion, or another sealing means.

The bottom container 102 and the sealing member 103 are formed from aluminum, an aluminum alloy, copper, a copper alloy, stainless steel, or another metal material having good thermal conductivity. The grooves 107 formed in the inner surface of the bottom container 102 are formed between plate-like fins 108 that are formed in an upright manner by carving out the metal material of the bottom container 102 with the carving tool blade described with reference to FIGS. 4 through 6.

The grooves 107 have the shapes depicted in FIG. 3(A) as previously described. In this case, however, the plate-like grooves 7A depicted in FIG. 3(B) can also be used.

The plate-type heat pipe 101 is set inside a notebook personal computer, for example. The condensing part 106 of the plate-type heat pipe 101 is installed so as to be bonded to a heat-radiating member 111 of the metal plate provided inside the case of the personal computer, as shown in FIG. 18. The evaporating part 105 of the bottom container 102 is installed on the top surface of a CPU 112 in a manner that allows heat transfer. The plate-type heat pipe 101 is also attached inside the personal computer by a suitable means.

In the plate-type heat pipe 101 thus configured, a hollow communication tube 109 that protrudes outward from the sealing member 103 is integrally formed on the sealing member 103, and a communication hole 110 for communicating the hollow part 104A with the exterior is formed in the communication tube 109, as shown in FIG. 17. The communication tube 109 is formed near the corner of the sealing member 103, at a position that corresponds to the end of the grooves 107 formed in the bottom container 102, as shown in FIG. 19. The communication tube 109 is formed by burring, for example, or another suitable means. Also, a communication tube 109 may be formed near each of two corners at the opposite ends of a diagonal on the sealing member 103, as shown in FIG. 18. An application example of a case in which two communication tubes 109 are formed will be described later.

Figure 20:
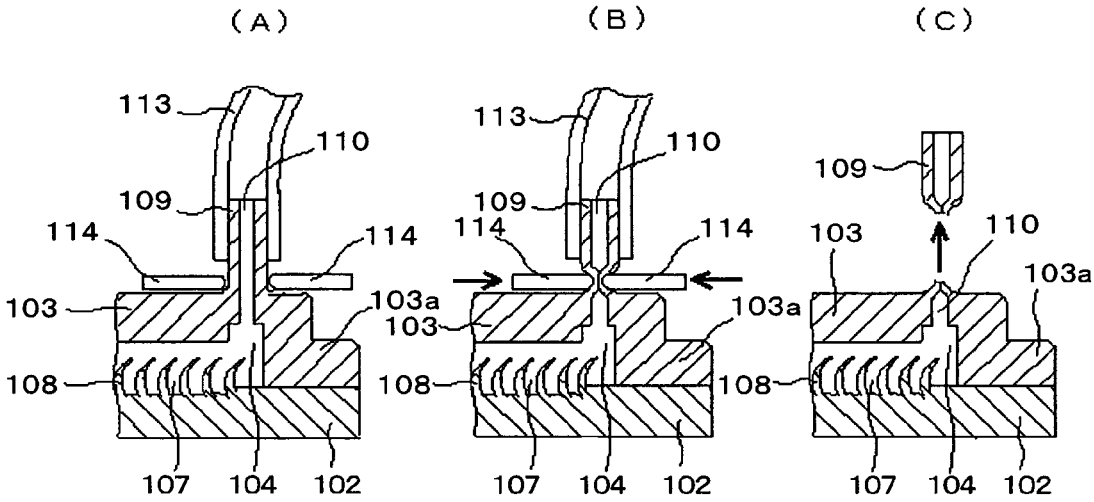
FIGS. 20(A), 20(B), and 20(C) are process diagrams depicting the working fluid sealing method in the plate-type heat pipe in FIG. 1.

FIG. 20 is an explanatory diagram depicting a method for sealing a working fluid in the plate-type heat pipe 101. First, a feed pipe connected to working fluid feeding means (not shown) is inserted into the communication tube 109, and a specific amount of working fluid is poured in. The working fluid is caused to penetrate into the grooves 107 by the capillary pressure of the grooves 107, which act as wicks. The working fluid may also be poured in by inserting a feed needle such as an injection needle, for example, into the communication hole 110 of the communication tube 109.

Next, as shown in FIG. 20(A), a deaeration pipe 113 connected to deaeration means composed of a vacuum pump (not shown) is connected to the communication tube 109, and the hollow part 104A is vacuum-degassed. When the hollow part 104A has been degassed to specific vacuum state, the communication hole 110 is sealed by using a pair of left and right compression tools 114 to apply pressure to, and compress the base portion of, the communication tube 109 while the deaeration pipe 113 is still connected to the communication tube 109, as shown in FIG. 20(B). As a result, the hollow part 104A of the plate-type heat pipe 1-1 can be brought to a vacuum state after the working fluid has been poured in. Then, the base portion of the communication tube 109 that has been compressed by the compression tools 114 is cut away by a suitable cutting means, as shown in FIG. 20(C).

At this time, the base portion of the sealed communication tube 109 remains in the surface of the sealing member 103 in a state of slight protrusion as a part that seals the communication hole. Forming the communication tube 109 at a position separated from the heat-radiating member 11 or CPU 12 of the personal computer has no effect. In cases in which the protruding communication hole sealing part is made flat, this part can then be formed at the same height as the surface of the sealing member 103 by flash molding.

The method for manufacturing the plate-type heat pipe 101 is identical to that of the plate-type heat pipe 1 described with reference to FIGS. 4 through 6. The plate-type heat pipe 101 can also be manufactured using a hoop-type metal plate such as is shown in FIG. 9.

Modifications of Embodiment 2

Figure 21:
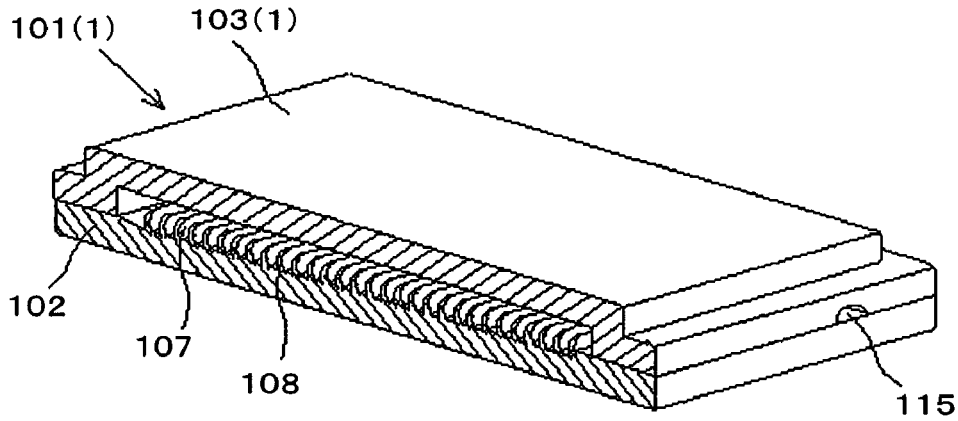
FIG. 21 is a partial cross-sectional perspective view depicting an example of a plate-type heat pipe comprising communication holes that have different structures, and a process diagram depicting the working fluid sealing method thereof.
Figure 21:
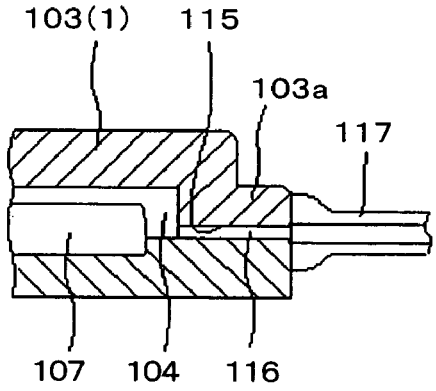
Figure 21:
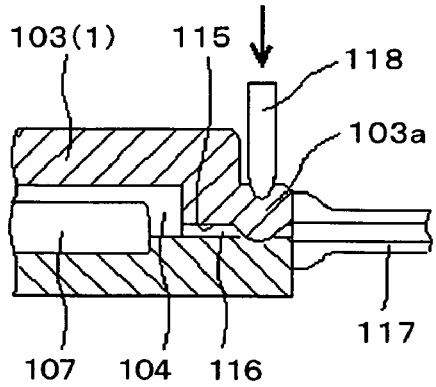

FIG. 21 depicts a modification of the communication hole for communicating the hollow part 104A of the plate-type heat pipe 101 with the exterior. In the plate-type heat pipe 101(1) depicted in FIG. 21(A), a concave groove 115 (communication groove) is formed in the connected surface (joined surface) of the bottom container 102 formed on the outer edge of the sealing member 103(1), and a communication hole 116 is formed in the concave groove 115 by joining the sealing member 103(1) with the outer edge portion of the bottom container 102. The concave groove 115 can be formed when the sealing member 103 is press-worked. A concave groove 115 may also be formed near each of two corners at opposite ends of a diagonal on the sealing member 103. Furthermore, the concave groove 115 may be formed on the side of the bottom container 102, or a groove may be formed on both of the outer edge portions of the sealing member 103(1) and the bottom container 102.

The method for sealing the working fluid in the plate-type heat pipe 101(1) that uses a communication hole 116 formed from a concave groove 115 will now be described with reference to FIGS. 21(B) and 21(C). First, the distal end of a feed pipe connected to working fluid feeding means (not shown) is connected to the communication hole 116, and a specific amount of working fluid is poured in. This working fluid is caused to penetrate into the grooves 107 by the capillary pressure of the grooves 107, which act as wicks. The working fluid may also be poured in by inserting a feed needle such as an injection needle, for example, into the communication hole 116.

Next, as shown in FIG. 21(C), the distal end of a deaeration pipe 117 connected to deaeration means (not shown) is connected to the communication hole 116, and the hollow part 104A is vacuum-degassed. When the hollow part 104A has been degassed to a specific vacuum state, the communication hole 116 is closed off by subjecting the joined part of the sealing member 103 to pressure from above with a punch or another pressure tool 118 while the deaeration pipe 117 is still connected to the communication hole 116 of the concave groove 115. As a result, the hollow part 104A of the plate-type heat pipe 101(1) can be brought to a vacuum state after the working fluid has been poured in.

Figure 22:
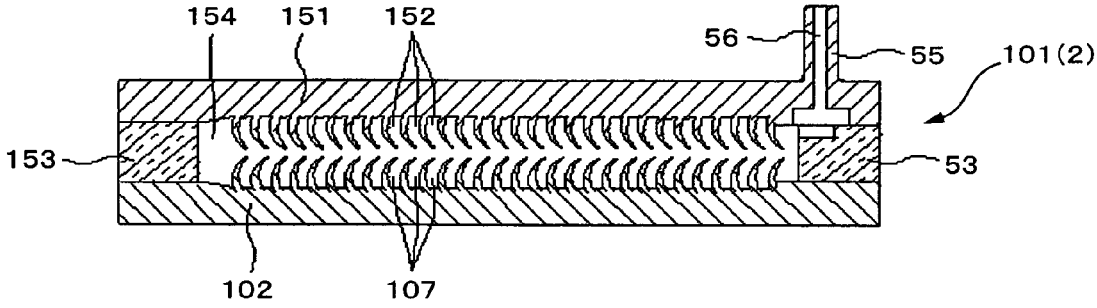
FIG. 22 is a cross-sectional view depicting a modification of the plate-type heat pipe.

FIG. 22 depicts a modification of the plate-type heat pipe 101. In the plate-type heat pipe 101(2) depicted in this diagram, grooves 152 are formed in the inner surface of a sealing member 151 in the same manner as in the bottom container 102. The sealing member 151 is laid over the bottom container 102 via a spacer 153 in a manner such that the grooves 152 face the grooves 107, the peripheral edges of the grooves are joined together, and a hollow part 154 having an airtight structure is formed in the interior. Furthermore, a hollow communication tube 155 that protrudes outward is integrally formed near the corner of the sealing member 151, similar to the sealing member 103 previously described, and a communication hole 156 for communicating the hollow part 154 with the exterior is formed in the communication tube 155. The same metal material as the one used for the bottom container 102 and the sealing member 151 is preferably used for the spacer 153.

Thus, as a result of forming grooves 152 on the sealing member 151 in the same manner as on the bottom container 102, a greater amount of working fluid moves between the evaporating part 5 and the condensing part 6 previously described. Moreover, since the grooves 107 and the grooves 152 have sufficient capillary force, a large amount of working fluid repeatedly moves and undergoes phase transformation, and it is therefore possible to provide a highly functional liquid-cooled heat exchanger. Since the grooves 107 and the grooves 152 are formed respectively on the sealing member 151 and the bottom container 102, functionality is not reduced even if the alignment is changed, such as if the front and back are reversed.

Figure 23:
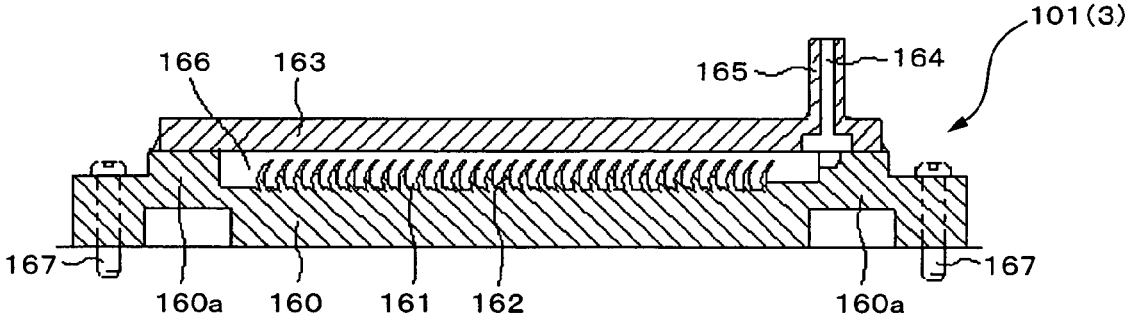
FIG. 23 is a cross-sectional view depicting a modification of the plate-type heat pipe.

In the plate-type heat pipe 101(3) depicted in FIG. 23, an example is shown in which a sealing member 163 composed of a flat metal plate is placed over the open end face of a flange 160*a* of a bottom container 160. In the bottom container 160, grooves 161 are formed in the inner surface of the concavity that is formed into a substantial plate shape, and the flange 160*a*, whose open side is flattened, is formed around the outer periphery. Also, the height of the fins 162 that form the grooves 161 is less than the depth of the concavity. Furthermore, a hollow communication tube 164 that protrudes outward is integrally formed in the flat sealing member 163, similar to the sealing member 103 previously described, and a communication hole 165 for communicating a hollow part 166 with the exterior is formed in the communication tube 164.

A deaeration pipe connected to a deaeration means composed of a vacuum pump (not shown) is fitted in and connected to the communication tube 164 of the sealing member 163, and the hollow part 166 is vacuum-degassed. When the hollow part 166 has been degassed to a specific vacuum state, the communication hole 165 is sealed by using compression tools to apply pressure to and compress the proximal end of the communication tube 164 while the deaeration pipe is still connected to the communication tube 164. As a result, the hollow part 166 of the plate-type heat pipe can be brought to a vacuum state after the working fluid has been poured in. The base portion of the communication tube 164 that has been compressed by the compression tools 114 is cut away by a suitable cutting means. The numerical symbol 167 in FIG. 23 denotes a screw for fixing the bottom container 160 in place on the heat-radiating member 11 provided in the above-described personal computer.

Figure 24:
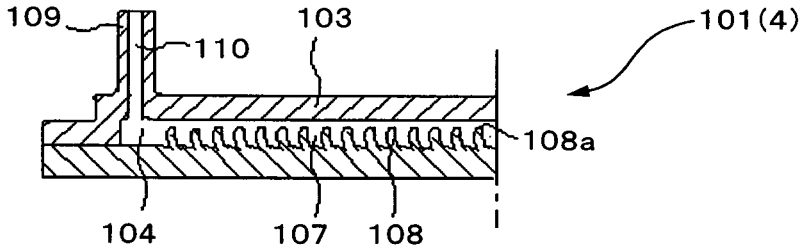
FIG. 24 is a cross-sectional view depicting a modification of the plate-type heat pipe.

In the plate-type heat pipe 101(3) depicted in FIG. 23, for example, the distal end portions of the plate-like fins 162 may be cut away to reduce the depths of the grooves. Specifically, the fins can be cut away as was described with reference to FIG. 13. FIG. 24 depicts a plate-type heat pipe 101(4) comprising shallow grooves 107(4) and fins 108(4) that have been cut in such a manner.

Figure 25:
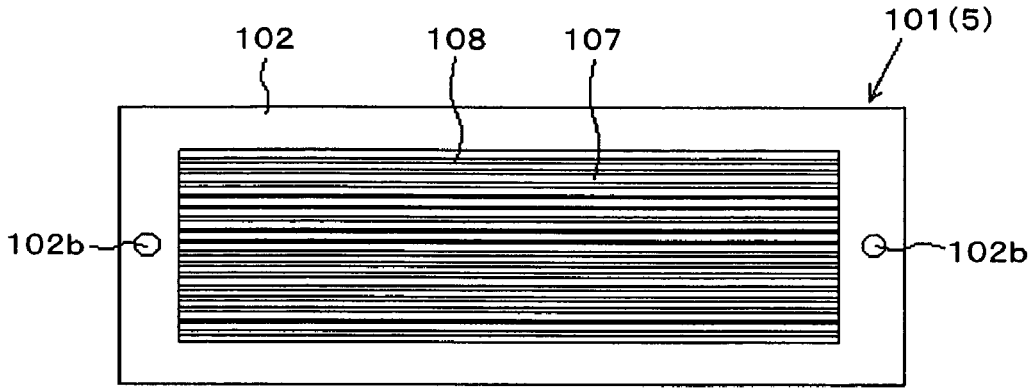
FIG. 25 is a plan view and a partial cross-sectional view depicting an example of a plate-type heat pipe comprising positioning means.
Figure 25:
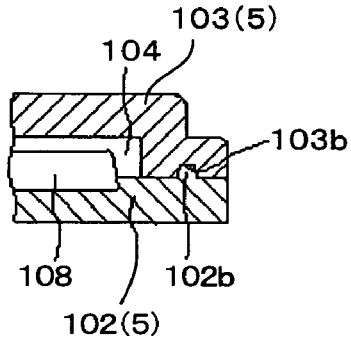

FIG. 25 depicts an example of positioning means for accurately positioning and joining together a sealing member and a bottom container in the plate-type heat pipe. The essential structure of the plate-type heat pipe 101(5) depicted in this diagram is identical to that of the plate-type heat pipe in FIGS. 17 through 19. In this plate-type heat pipe 101(5), protuberances 102*b* that are formed into substantial cylinders are formed at both the left and right sides of the bottom container 102(5). Fitting holes 103*b* are formed in the sealing member 103(5) at positions corresponding to the protuberances 102*b*.

When the sealing member 103(5) is placed over the bottom container 102(5), the protuberances 102*b* of the bottom container 102 fit into the fitting holes 103*b* in the sealing member 103, whereby the sealing member 103(5) and the bottom container 102(5) are accurately positioned. A hollow part 104 having an airtight structure is then formed in the interior by sealing the outer peripheral portions of the sealing member 103(5) and the bottom container 102(5).

Another possibility is to form the protuberances 102*b* on the sealing member 103(5), and the fitting holes 103*b* in the bottom container 102(5). Yet another possibility is to form the protuberances 102*b* into substantial truncated cones, to form the fitting holes 103*b* into substantial mortar shapes, and to absorb any difference in dimensions between the outside diameter of the protuberances 102*b* and the inside diameter of the fitting holes 103*b*.

Yet another possibility is a configuration wherein a protuberance 102*b* is formed into a pier shape encircling the vicinity of the outer peripheral edge of the bottom container 102, for example; a groove-shaped fitting hole 103*b* is formed encircling the vicinity of the outer peripheral edge of the sealing member 103(5); and the two are fitted together when the sealing member 103(5) is placed over the bottom container 102(5). The result of fitting the encircling protuberance 102*b* into the fitting hole 103*b* in this manner is that, evidently, the sealing member 103(5) and the bottom container 102(5) can be positioned accurately, and that the fitted portion takes on a labyrinth configuration, further increasing the airtightness in the hollow part 104.

Figure 26:
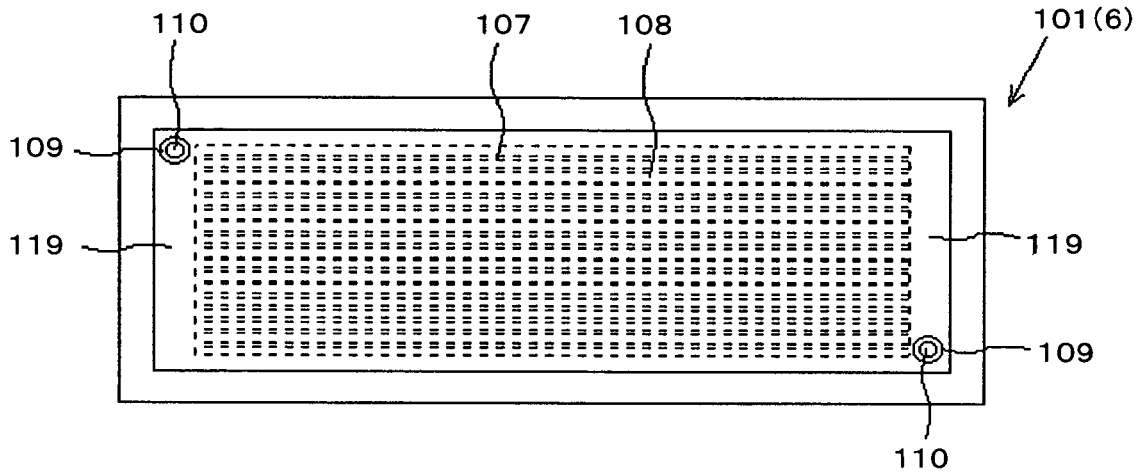
FIG. 26 is a plan view depicting an example of a plate-type heat pipe in which communication holes are formed at two locations.
Figure 27:
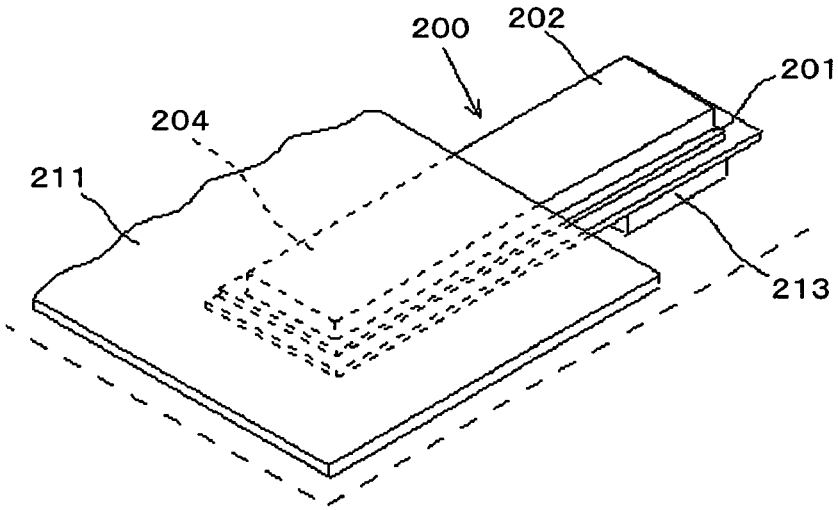
FIG. 27 is a perspective view depicting the manner in which a conventional plate-type heat pipe is used, and a partial cross-sectional view depicting the grooves thereof.
Figure 27:
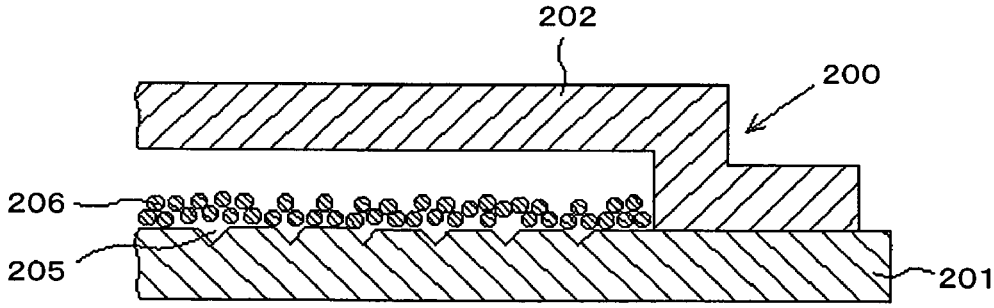

FIG. 26 depicts an example of a plate-type heat pipe having a configuration in which two communication tubes 109 are formed in the above-described plate-type heat pipe 101. The communication tubes 109 of this plate-type heat pipe 101(6) are located in the corners of the sealing member 103, and are formed at positions corresponding to the outer sides of the grooves 107 formed in the bottom container 102. Gaps instead of grooves 107 are formed at the locations in the bottom container 102 corresponding to the two communication tubes 109, as is depicted in the diagram. These gaps are configured as liquid retaining parts 119 for storing the working fluid. Providing liquid retaining parts 119 in this manner makes it possible for a sufficient amount of working fluid to be stored, and allows the working fluid to be supplied sequentially to the grooves 107. It is thereby possible for a sufficient amount of working fluid to be moved between the condensing part 6 and the evaporating part 5.

In cases in which two communication tubes 109 are formed, the configuration can be that of a water-cooled radiator instead of a plate-type heat pipe. In other words, the two communication tubes 109 are communicated with the hollow part 104 between the sealing member 103 and the bottom container 102. A pipe (not shown) is connected to one communication tube 109 as a feed hole for a water-cooling liquid, and the cooling water is poured into the hollow part 104 and is then discharged through the other communication tube 109 as a discharge port. A circulated liquid-cooled heat exchanger is thereby configured so that the water-cooling liquid poured in from the one communication tube 109 fills in the grooves 107; heat is exchanged with the CPU, for example, inside the personal computer; and the water-cooling liquid, which has increased in temperature, is then discharged from the other communication tube 109 as a discharge port. In this case, the water-cooling liquid is stored in the liquid retaining parts 119.

Other Modifications and Variations

The embodiments described above were designed so that fins were formed in an upright manner and grooves were formed by moving a carving tool while the metal plate was positioned and fixed in place, but another possibility is to form the fins by moving the metal plate, or to form the fins in an upright manner by moving both the metal plate and the carving tool relative to each other. Yet another possibility is to use a metal material having good thermal conductivity for the bottom container that is joined to the CPU and to the heat-radiating member, and to form the top container by combining a different metal material that has lower thermal conductivity than the bottom container. Thus, the present invention is not limited to these embodiments, and various modifications can be made within a range that does not deviate from the present invention.

The invention claimed is:

1. A plate-type heat exchanger, comprising:

a plate-type container of a workable metal material of a specific thermal conductivity;

an airtightly structured hollow part formed in an interior of the container, the hollow part defining an inside surface portion;

a heat medium sealed in the hollow part;

a plurality of curved fins, each fin having a distal end and being spaced apart from at least one other fin along the inside surface portion, each said fin and the inside surface portion together defining a plurality of inset corners at least one of which is an acute angle; and a plurality of heat-medium-guiding grooves formed between the fins, the heat-medium-guiding grooves each having a width, defined between adjacent fins, that allows the heat medium to be moved along the heat-medium-guiding grooves by capillary force, each said groove having an inner closed end adjacent the inside surface portion, and an outer open end, each said fin gradually decreasing in thickness as each said fin extends and curves away from the inside surface portion to the distal end of said fin, such that the width of each said groove increases as the groove extends from the inner closed end of the groove to the outer open end of the groove; wherein the fins have a thickness of 0.1 mm to 1.0 mm and the inner closed end of each groove having a width of 0.01 mm to 1.0 mm, and each groove having a depth of 0.1 mm to 1.0 mm.

2. The plate-type heat exchanger according to claim 1, wherein each said groove is rectangularly shaped along a horizontal cross section in which the groove is located.

3. The plate-type heat exchanger according to claim 1, wherein the container comprises a container main body and a container lid placed over the container main body, and wherein the hollow part is formed on inner sides of airtight frame-shaped joining surfaces between the container main body and the container lid; and a concavity for forming the hollow part on the inner sides of the frame-shaped joining surfaces is formed in at least one of the container main body and the container lid.

4. The plate-type heat exchanger according to claim 1, further comprising a communication hole in the container to communicate the hollow part with the exterior of the plate-type container, for pouring in the heat medium and vacuum-degassing the hollow part, and a communication hole seal in the container, the communication hole seal being formed by sealing the communication hole.

5. The plate-type heat exchanger according to claim 4, further comprising medium-accumulating parts formed in regions adjacent ends of the grooves in the hollow part, the communication hole having an open end on the hollow part side facing the medium-accumulating parts.

6. The plate-type heat exchanger according to claim 4, further comprising two communication hole seals and two communication holes adjacent ends of the grooves being sealed.

7. The plate-type heat exchanger according to claim 4, wherein the communication hole seal is a crushed and cut away base portion of a communication tube that protrudes from the outside surface of the container in communication with the communication hole.

8. The plate-type heat exchanger according to claim 4, wherein the container comprises a container main body and a container lid placed over the container main body;

the hollow part is formed on inner sides of airtight frame-shaped joining surfaces between the container main body and the container lid;

a concavity for forming the hollow part on the inner sides of the frame-shaped joining surfaces is formed in at least one of the container main body and the container lid;

the communication hole is formed from a communication groove that is formed on a side of at least one of the container main body and the container lid along the frame-shaped joining surfaces; and the communication hole seal is formed by applying pressure to and blocking off the communication groove.

9. The plate-type heat exchanger according to claim 1, wherein the metal material of the container is at least one of aluminum, an aluminum alloy, copper, a copper alloy, and stainless steel.

* * * * *